US008266752B2

(12) United States Patent
Henkin et al.

(10) Patent No.: US 8,266,752 B2
(45) Date of Patent: Sep. 18, 2012

(54) POOL CLEANER CONTROL SUBSYSTEM

(75) Inventors: Melvyn L. Henkin, Ventura, CA (US); Jordan M. Laby, Ventura, CA (US)

(73) Assignee: Henkin-Laby, LLC, Ventura, CA (US)

( * ) Notice: Subject to any disclaimer, the term of this patent is extended or adjusted under 35 U.S.C. 154(b) by 1334 days.

(21) Appl. No.: 11/974,326

(22) Filed: Oct. 12, 2007

(65) Prior Publication Data

US 2008/0060984 A1 Mar. 13, 2008

Related U.S. Application Data

(63) Continuation-in-part of application No. PCT/US2006/017283, filed on May 4, 2006.

(60) Provisional application No. 60/678,499, filed on May 5, 2005.

(51) Int. Cl.
*B08B 3/02* (2006.01)

(52) U.S. Cl. ..... 15/1.7; 210/97

(58) Field of Classification Search ..... 15/1.7; 210/97, 103, 143

See application file for complete search history.

(56) References Cited

U.S. PATENT DOCUMENTS

| | | | | |
|---|---|---|---|---|
| 4,154,680 | A | 5/1979 | Sommer | |
| 4,835,809 | A | 6/1989 | Roumagnac | |
| 4,837,886 | A | 6/1989 | Rawlins | |
| 4,849,024 | A | 7/1989 | Supra | |
| 5,197,158 | A | 3/1993 | Moini | |
| 5,337,434 | A | 8/1994 | Erlich | |
| 5,435,031 | A | 7/1995 | Minami | |
| 5,985,156 | A | 11/1999 | Henkin et al. | |
| 6,039,886 | A | 3/2000 | Henkin et al. | |
| 6,090,219 | A | 7/2000 | Henkin et al. | |
| 6,280,611 | B1 | 8/2001 | Henkin et al. | |
| 6,294,084 | B1 | 9/2001 | Henkin et al. | |
| 6,365,039 | B1 | 4/2002 | Henkin et al. | |
| 6,387,250 | B1 | 5/2002 | Henkin et al. | |
| 6,485,638 | B2 | 11/2002 | Henkin et al. | |
| 6,652,742 | B2 | 11/2003 | Henkin et al. | |
| RE38,479 | E * | 3/2004 | Henkin et al. | 210/103 |

FOREIGN PATENT DOCUMENTS

WO PCT/US00/31156 5/2001

* cited by examiner

*Primary Examiner* — Shay Karls
(74) *Attorney, Agent, or Firm* — Arthur Freilich

(57) ABSTRACT

A method and apparatus for operating a pool cleaner body in a manner to maximize the time spent on cleaning relative to the time spent on repositioning. More particularly, the invention is directed to a control subsystem for operating a cleaner body to enable it to primarily travel in a forward direction (i.e., forward state) along a travel path but operable also in a backup/redirect state to translate and or rotate the body to enable it to escape from obstructions while also minimizing the formation of conduit tangles. The control subsystem is configured to perform reposition operations without increasing incidents of conduit tangling by:

1—avoiding an excessive rotation of the body, e.g., approximately 180° or more, when attempting to free the body from an obstruction; and/or 2—avoiding the initiation of a timed reposition operation while the body is transitioning between a travel path at the wall surface and a travel path at the water surface.

26 Claims, 17 Drawing Sheets

POOL CLEANER CONTROL SUBSYSTEM

RELATED APPLICATIONS

This application is a CIP of PCT/US2006/017283 filed on 4 May 2006 which claims priority based on U.S. Application 60/678,499 filed on 5 May 2005. This application claims priority based on the aforecited applications which my reference are incorporated herein.

FIELD OF THE INVENTION

This invention relates generally to automatic swimming pool cleaners of the type which use a cleaner body for traveling through a water pool to clean the water and/or containment wall surfaces and more particularly to such cleaners in which the cleaner body is tethered to a conduit which supplies power (e.g., positive pressure water flow, negative pressure (i.e., suction) water flow, electricity, etc.) for propelling the body through the water pool.

BACKGROUND OF THE INVENTION

Well known automatic pool cleaners utilize a cleaner body coupled to a flexible conduit which supplies power to propel the body forwardly along a substantially random travel path though the pool. For example, U.S. Pat. Nos. 6,090,219 and 6,365,039 (reissued as RE 38,479) describe automatic pool cleaners which use a body powered by supplied positive pressure water for cleaning the interior surface of a pool containment wall and the upper surface of a water pool contained therein. Other U.S. patents describe cleaner bodies which are powered by a negative pressure water source and/or electric power. Regardless of the particular body configuration and power source a number of known cleaners include some type of timer mechanism for periodically initiating a timed "back-up" or "repositioning" operation to allow the body to escape form being trapped by an obstruction in the pool and/or enhance randomization of the body's travel path. Additionally, some available patent documents (e.g., U.S. Pat. No. 6,365,039; U.S. Pat. No. 6,398,878; PCT/US2004/016937) suggest the inclusion of a motion sensor for sensing when the rate of forward motion of the cleaner body diminishes below a certain threshold rate. This can occur, for example, when the body gets trapped by an obstruction. The sensed decrease in the rate of forward motion can be used to initiate the repositioning operation to free the body.

Aforementioned U.S. Pat. No. 6,398,878 describes an automatic swimming pool cleaner which includes a propulsion subsystem for producing a force $F_P$ for propelling a cleaner body in a forward direction, a motion sensor for reporting when the body's rate of forward motion is less than a certain threshold rate, and a repositioning subsystem for producing a force $F_R$ for redirecting the body's forward motion along a different travel path. The preferred repositioning subsystem described in said '678 patent redirects the body by applying the force $F_R$ (FIGS. 1A, 1B) in a direction to translate the body rearwardly and rotate it around an axis oriented substantially perpendicular to the direction of the body's forward motion. Aforementioned International application PCT/US2004/016937 describes an enhanced propulsion subsystem.

Although the application of the repositioning force $F_R$ as described in said '878 patent is generally effective to free a cleaner body trapped by an obstruction, it has been observed that excessive body rotation can contribute to the formation of tangles, e.g., persistent coils and/or knots, in the conduit supplying power to the body. The formation of such tangles is undesirable because tangles tend to impede the free travel of the body and increase the time dedicated to repositioning at the expense of the time available for cleaning. It has also been observed that tangles are more likely to occur when a timed repositioning operation is initiated while the body is transitioning between a travel path at the wall surface. (i.e., wall surface mode) and a travel path at the water surface (i.e., water surface mode).

SUMMARY OF THE INVENTION

The present invention is directed to a method and apparatus for operating a pool cleaner body in a manner to maximize the time spent on cleaning relative to the time spent on repositioning. More particularly, the invention is directed to a control subsystem for operating a cleaner body to enable it to primarily travel in a forward direction (i.e., forward state) along a travel path but operable also in a backup/redirect state to translate and/or rotate the body to enable it to escape from obstructions while also minimizing the formation of conduit tangles. A control subsystem in accordance with the invention is configured to perform repositioning operations without increasing incidents of conduit tangling by:

1—avoiding an excessive rotation of the body, e.g., approximately 180° or more, when attempting to free the body from an obstruction; and/or 2—avoiding the initiation of a timed repositioning operation while the body is transitioning between a travel path at the wall surface and a travel path at the water surface.

In accordance with the invention, a reposition operation is initiated in response to an "event" which can be time dependent (e.g., expiration of a timed interval) and/or condition dependent (e.g., rate of forward body motion falling below a certain threshold). In a preferred embodiment, the reposition operation is comprised of a sequence of one or more "redirect actions" where each such action redirects the body for forward motion along a new path and involves first applying a limited duration repositioning force $F_R$, then applying a forward propelling force $F_P$, and then determining the consequence of those forces on the cleaner body forward motion; i.e., have the applied forces produced sustained cleaner body forward motion? If sustained forward motion is recognized, the reposition operation is terminated. If sustained forward motion is not recognized, then the reposition operation continues with a further redirect action.

In a preferred control subsystem embodiment, the magnitude, or effectiveness, of each succeeding redirect action in a reposition operation is progressively increased. For example, an initial redirect action can apply the repositioning force $F_R$ for a first interval (e.g., about four seconds) to rotate the cleaner body approximately 90° to redirect it for forward motion along a different travel path. Then a second redirect action can apply the force $F_R$ for a second interval (e.g., about six seconds) to rotate the body approximately 135° to redirect it for forward motion along a still different path. Additional redirect actions can be sequentially executed if necessary to apply the force $F_R$ for increasing durations. In most situations, the body will be free of the obstruction after the first and/or second redirect actions, thereby avoiding the necessity of a third redirect action and the additional rotation which can promote conduit tangles.

Embodiments of the invention are compatible with many types of pool cleaners which use a conduit to supply power to a cleaner body. The power can be supplied in the form of positive or negative fluid pressure (e.g., water) or electricity. Moreover, embodiments of the invention can be used with cleaner bodies which travel solely along the containment wall surface or with bodies which alternately travel at the containment wall surface and at the water surface. In the latter type of cleaner (e.g., U.S. Pat. No. 6,365,039), to minimize forming conduit tangles, it has been found preferable to avoid initiating a timed repositioning operation while the cleaner body is transitioning from the wall surface to the water surface, or vice versa.

A control subsystem in accordance with the invention can be implemented in various ways to execute a reposition operation comprised of a sequence of one or more redirect actions. For example, a control subsystem in accordance with the invention can employ a mechanical, e.g., hydraulic, controller, using cams driven by the supplied power, or can employ an electronic controller, using a microprocessor, to respond to certain inputs for appropriately producing the aforementioned repositioning force $F_R$.

A control subsystem in accordance with the invention can operate "open loop", in the sense that the repositioning force $F_R$ can be applied for a certain interval, e.g., four seconds, to produce the desired body rotation, e.g., approximately 90°. Alternatively, the control subsystem can operate "closed loop", in the sense that the force $F_R$ is applied until a rotation sensor reports that the desired rotation magnitude has been achieved. More particularly, a preferred closed loop embodiment preferably includes means for monitoring the net rotation of the body accumulated during a reposition operation. The magnitude of the accumulated rotation can, for example, be derived by detecting the body's heading at the start of a reposition operation and comparing it to headings subsequently detected during the operation. The difference, of course, represents the net angle of rotation of the body. This information can then be used by the control subsystem controller to determine further actions. A suitable heading detector can employ a directional sensor such as a magnetic compass yaw device, GPS sensor, etc.

In a preferred embodiment of the invention, the cleaner body includes a housing having vent openings at the front and rear for allowing pool water to move (relative to the housing) therethrough as the cleaner body travels through the pool. The cleaner body includes a motion sensor which preferably channels the moving water through a window interior to the housing. The preferred motion sensor also includes a paddle mounted adjacent to the window for movement by the channeled water. When the velocity of the water relative to the housing (i.e., forward body motion) exceeds a threshold rate, the motion sensor paddle is forced to a first position causing it to close a relief port. On the other hand, when the relative water velocity is below the threshold rate, the paddle defaults to a second position to open the relief port and permit the initiation of a reposition operation.

The execution of a reposition operation in accordance with a preferred embodiment of the invention involves performing one or more successive redirect actions. In a preferred hydraulic embodiment, each redirect action uses one of multiple state cams driven by a common mechanism, for example, the shaft of a turbine powered by a supplied positive pressure water flow. A first of the state cams has one or more discontinuities, e.g., lobes, each of which opens a state valve to produce the reposition force $F_R$ for a first duration, e.g., four seconds. A second of the state cams has discontinuities which produce the force $F_R$ for a second duration, e.g., six seconds. A cam selector is provided so that the initial redirect action of each reposition operation uses the first state cam, i.e., the cam having the shortest duration lobes. The reposition operation is terminated when sustained forward motion greater than a threshold rate is sensed by the aforementioned motion sensing mechanism. If sustained forward motion is not recognized, then the repositioning operation continues to a second redirect action using the second state cam.

As previously mentioned, in a preferred embodiment, a reposition operation is initiated as a consequence of the motion sensor recognizing that the rate of forward motion is less than a certain threshold. Additionally, the reposition operation is preferably also initiated by a timed event to enhance randomization of the body's travel path even if its forward motion is being sustained. In a preferred embodiment, the timed event is defined by a state cam lobe arranged to force the paddle to the aforementioned second position to open the relief port.

In order to reduce the likelihood of conduit tangles, it is preferable to avoid, or inhibit, the initiation of a timed reposition operation while the cleaner body is transitioning between wall surface travel (i.e., wall surface mode) and water surface travel (i.e., water surface mode). In a preferred embodiment, this is accomplished by properly phasing a cam defining the operating state (i.e., state cam) which defines either a forward state or a backup/redirect state. A preferred mode cam is mounted for rotation and has cam surfaces which define the respective durations of the wall surface and water surface modes. A follower bears against the mode cam surfaces to control a mode valve to produce a vertical force (e.g., $F_{+V}$, $F_{-V}$) to place the body proximate to the water surface or wall surface.

A manually operable mode override mechanism is preferably provided to enable a user to assure operation (a) solely in the wall surface mode or (b) solely in the water surface mode or (c) alternately in the wall surface and water surface modes. The manually operable override mechanism in a first position holds the mode valve open to keep the cleaner body in the water surface mode, in a second position holds the mode valve closed to keep the body in the wall surface mode, and in a third position permits the valve to be controlled by the mode cam for operating alternatively in the water surface and wall surface modes.

DETAILED DESCRIPTION

Figure 1:
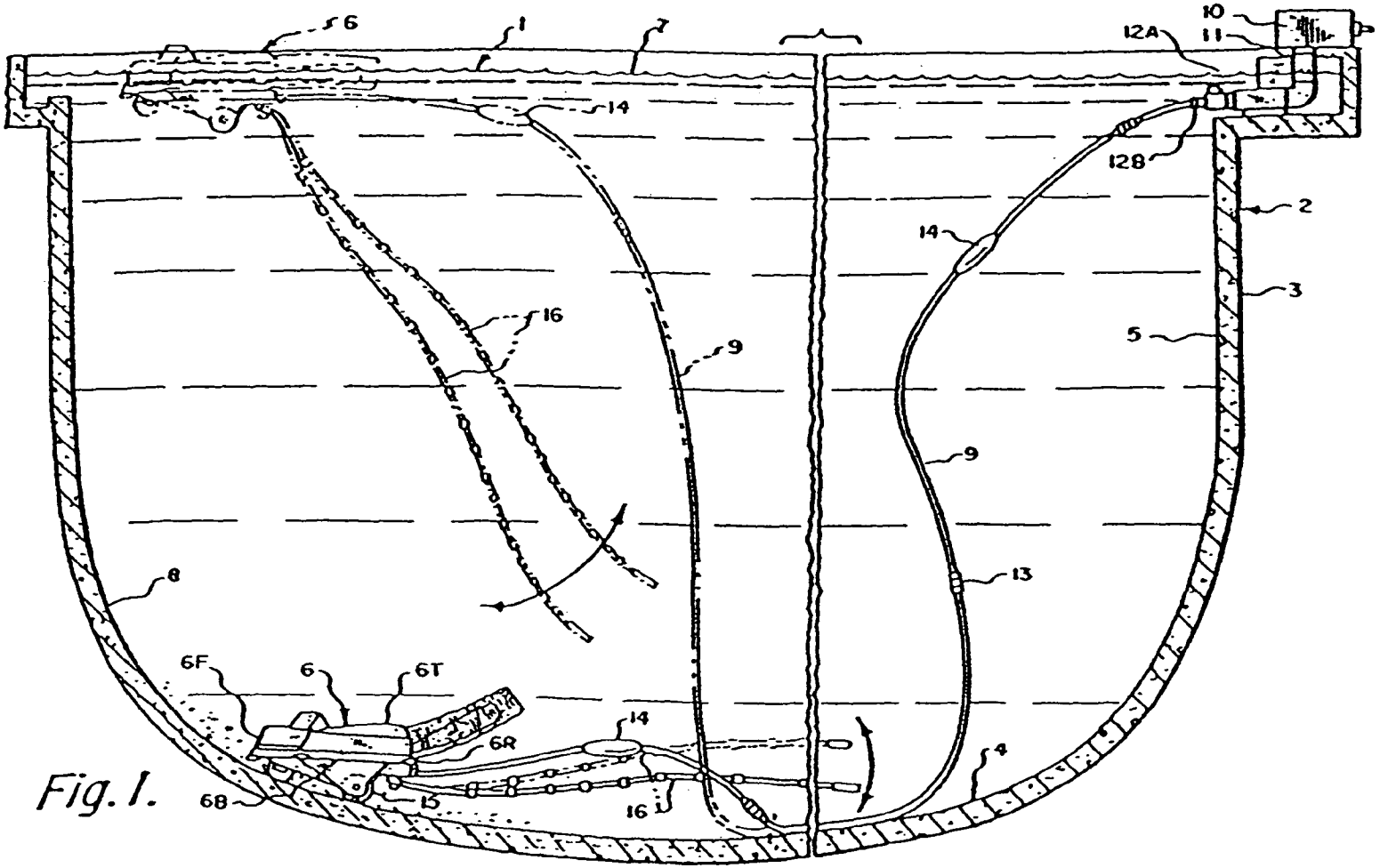
FIG. 1 corresponds to FIG. 1 of U.S. Pat. No. 6,365,039 and schematically depicts an automatic pool cleaner including a cleaner body for traveling along and cleaning the containment wall surface and/or the water pool surface.

Attention is initially directed to FIG. 1 which duplicates a corresponding figure shown in U.S. Pat. No. 6,365,039. FIG. 1 illustrates a method and apparatus for cleaning a water pool 1 contained in an open vessel 2 defined by a containment wall 3 having a bottom 4 and side 5 portions. The apparatus includes a unitary structure or body 6 configured for immersion in the water pool 1 for selective operation to the interior wall surface 8 in a wall surface cleaning mode.

The unitary body 6 preferably comprises an essentially rigid structure having a hydrodynamically contoured exterior surface for efficient travel through the water pool 1. FIG. 1 depicts a heavier-than-water body 6 which in its quiescent or rest state typically sinks to a position (represented in solid line) proximate to the bottom of the pool 1. For operation in the water surface cleaning mode, a vertical force $F_{+V}$ is produced to lift the body 6 to proximate to the water surface 7 (represented in dash line). Alternatively, body 6 can be configured to be lighter than water such that in its quiescent or rest state, it floats proximate to the water surface 7. For operation in the wall surface cleaning mode, a vertical force $F_{-V}$ is produced to cause the lighter-than-water body to descend to the pool bottom. In either case, the vertical force is produced as a consequence of energy/power (e.g., a positive pressure water flow) supplied via a conduit 9 from an energy/power source, e.g., an electrically driven motor and hydraulic pump assembly 10. The exemplary assembly 10 defines a pressure side outlet 11 preferably coupled via a pressure/flow regulator 12A and quick disconnect coupling 12B to the conduit 9. The conduit 9 can be formed of multiple sections coupled in tandem, e.g., by hose nuts and swivels 13. Further, appropriately placed floats and/or weights 14 can be distributed along the conduit length.

As represented in FIG. 1, the body 6 generally comprises a top portion or frame 6T and a bottom portion or chassis 6B, spaced in a nominally vertical direction. The body also generally defines a front or nose portion 6F and a rear or tail portion 6R spaced in a nominally horizontal direction. The body is supported on a traction means such as wheels 15 whose orientation defines the body's direction of forward motion. A sweep hose 16 trails from the body 6 for sweeping the wall surface.

Figure 2:
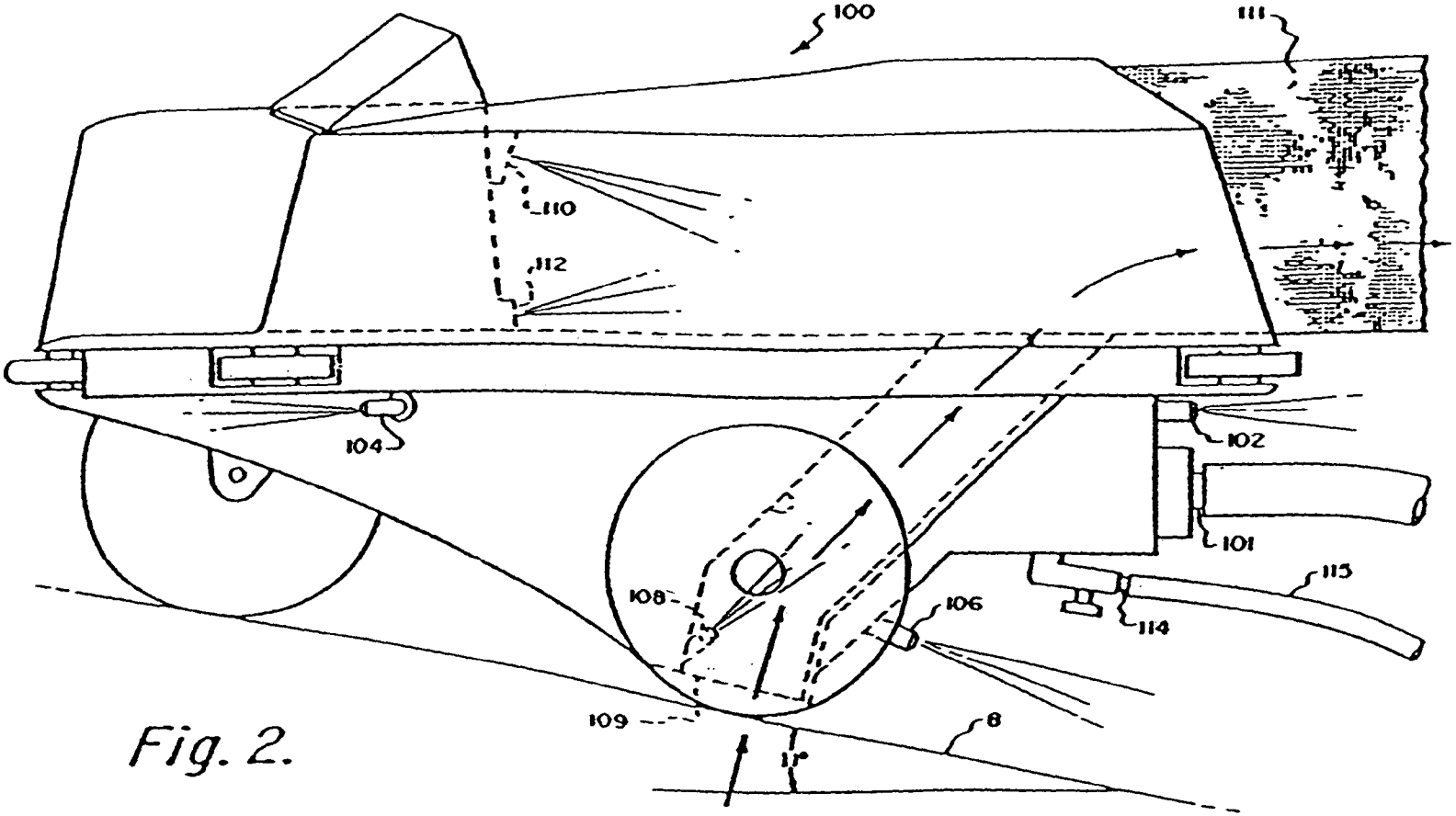
FIG. 2 corresponds to FIG. 2 of U.S. Pat. No. 6,365,039 and schematically depicts an exemplary cleaner body showing multiple outlets which can be selectively activated to discharge water flows to establish the body's operating mode (i.e., wall surface or water surface) and state (i.e., forward or backup/redirect)

Attention is now directed to FIG. 2 which substantially corresponds to FIG. 2 of U.S. Pat. No. 6,365,039 and schematically depicts an exemplary cleaner body 100 having a positive pressure water supply inlet 101 and multiple water outlets which can be variously used by the body 100 in its different operating modes and states. The outlets active during the forward state and during the backup/redirect state are respectively shown in FIGS. 3A-3D and FIGS. 4A-4D.

With reference to FIG. 2, the following exemplary water outlets are depicted:

102—Forward Thrust Nozzle; provides forward propulsion and a downward force in the wall surface cleaning mode to assist in holding the wheels 15 against the wall surface 8.

104—Backup/Redirect Thrust Nozzle; provides backward propulsion and rotation of the body around a substantially vertical axis when in the backup/redirect state;

106—Forward Thrust/Lift Nozzle; provides thrust to lift the cleaner body to the water surface and to hold it there and propel it forwardly when operating in the water surface cleaning mode;

108—Vacuum Jet Pump Nozzle; produces a high velocity jet to create a suction at the vacuum inlet opening 109 to pull in water and debris from the adjacent wall surface 8 in the wall surface cleaning mode;

110—Skimmer Nozzles; provide a flow surface water and debris into a debris container 111 when operating in the water surface cleaning mode;

112—Debris Retention Nozzles; provides a flow of water toward the mouth of the debris container 111 to keep debris form escaping when operating in the backup/redirect state;

114—Sweep Hose; discharges a water flow through hose 115 to cause it to whip and sweep against wall surface 8.

Figure 3C:
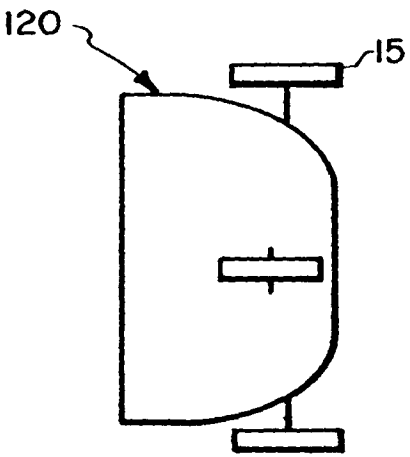
FIGS. 3A, 3B, 3C, 3D schematically illustrate respective top, side, front, and rear views of a cleaner body showing an exemplary configuration of nozzles for discharging respective water flows to propel the body forwardly along a travel path at the wall surface or at the water surface.
Figure 3A:
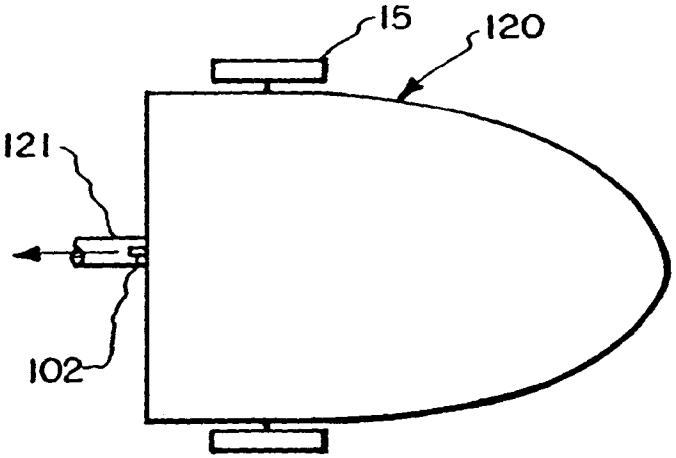
Figure 3B:
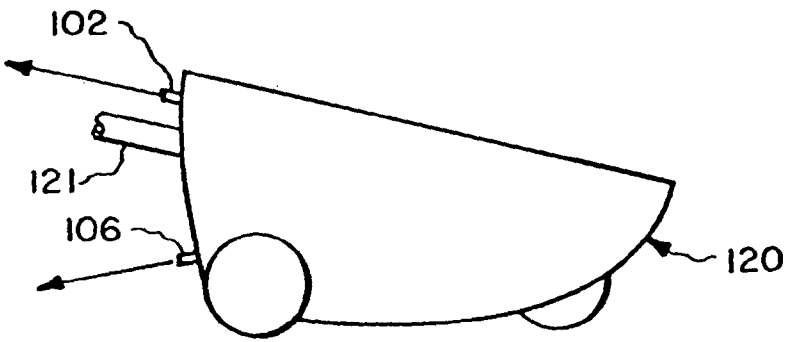
Figure 3D:
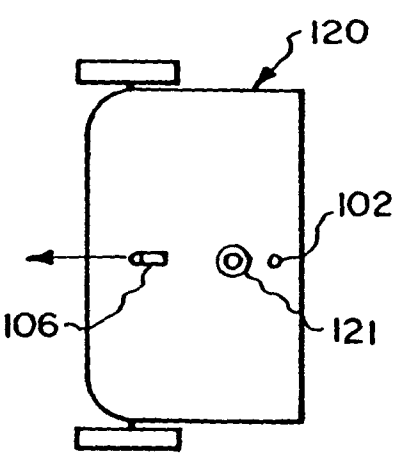
Figure 4C:
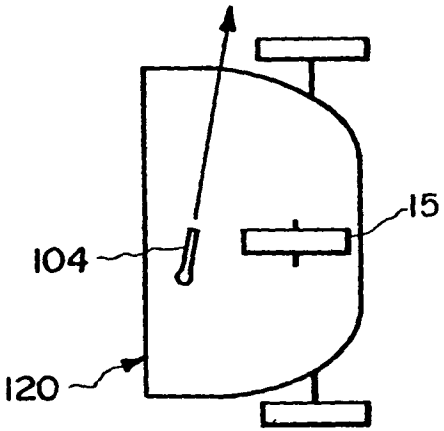
FIGS. 4A, 4B, 4C, 4D schematically illustrate respective top, side, front, and rear views of the pool cleaner of FIG. 3 showing an exemplary configuration of nozzles for discharging respective water flow for redirecting the body's travel path in the backup/redirect state.
Figure 4A:
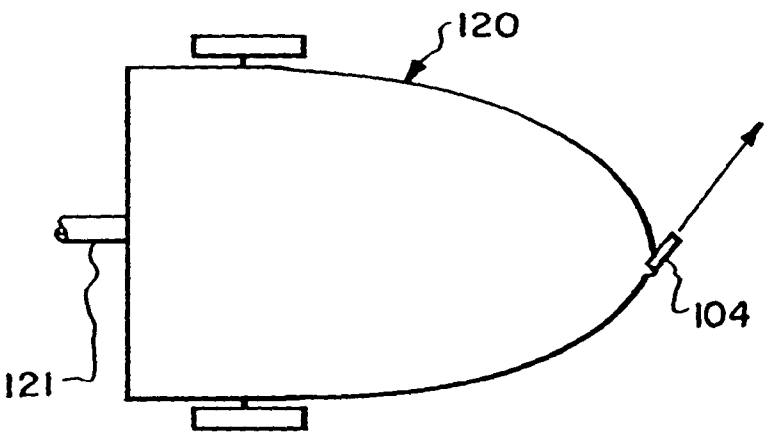
Figure 4B:
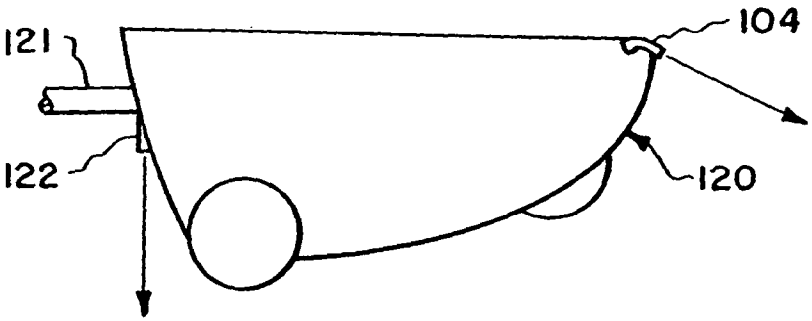
Figure 4D:
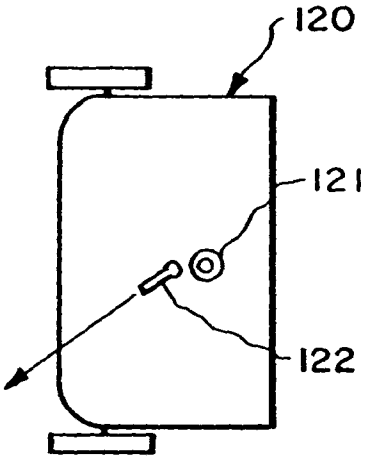

Attention is now directed to FIGS. 3A, 3B, 3C and 3D which are similar to like numbered Figures in PCT/US2004/016937 and which schematically illustrate top, side, front, and rear views of an exemplary cleaner body 120. These figures show a power supply conduit 121 and the primary water nozzles for discharging water jets during wall surface and/or water surface cleaning modes for forward propulsion. Note initially that FIGS. 3A, 3B, and 3D illustrate a forward thrust nozzle 102 oriented to discharge a water jet rearwardly and downwardly substantially along the longitudinal centerline of the body 120 to produce a force $F_P$ for propelling the body in the forward direction defined by wheels 15 and a force $F_{-V}$ for holding the wheels against the wall surface.

FIGS. 3B and 3D illustrate a forward/lift discharge nozzle 106 mounted at the rear of body 120 below the nozzle 102 but also substantially aligned with the longitudinal center line of the body 120. Note that the nozzle 106 is oriented to discharge a water jet rearwardly and downwardly to produce a vertical force $F_{+V}$ for lifting the body 120 to the water surface and a forward thrust $F_P$ for propelling the body 120 along the water surface. The jet discharged from nozzle 106 acts to maintain the body 120 at the water surface while propelling it forwardly in the forward/water surface travel state.

Attention is now directed to FIGS. 4A, 4B, 4C, and 4D which also are similar to like numbered Figures in PCT/US2004/016937 and which schematically illustrate the top, side, front, and rear views of the cleaner body 120 showing a front backup/redirect nozzle 104 and an additional rear backup/redirect nozzle 122. The nozzles 104 and 122 are used during backup/redirect state to execute a reposition operation to redirect the travel path of the body 120. More particularly, note in FIG. 4A that nozzle 104 mounted at the front of body 120 is oriented to discharge a water jet having a horizontal component extending to the left and that nozzle 122 mounted at the rear of body 120 is oriented to discharge a water jet having a horizontal component extending to the right. The forces $F_R$ attributable to these oppositely directed horizontal components discharged from spaced nozzles 104 and 122 act cooperatively to produce a turning moment around the body's center of gravity to rotate the body in a clockwise direction and enable it to resume forward travel along a different redirected path. In order to facilitate rotation of the body 120 when operating in the wall surface mode with wheels 15 engaged against wall surface 8, it is preferable that the body be lifted slightly to disengage the wheels 15 from the wall surface. Accordingly, it is preferable that at least one of the nozzles 104, 122 be oriented so that the jet discharged therefrom has a vertical component acting to life the body and wheels from the wall surface. It should also be noted in FIG. 4A that the nozzle 104 is oriented so that the jet discharged therefrom has a forward component to produce a force acting to cause the body to move rearwardly, i.e., backup, to facilitate the body extricating itself from behind an obstruction.

Figure 5:
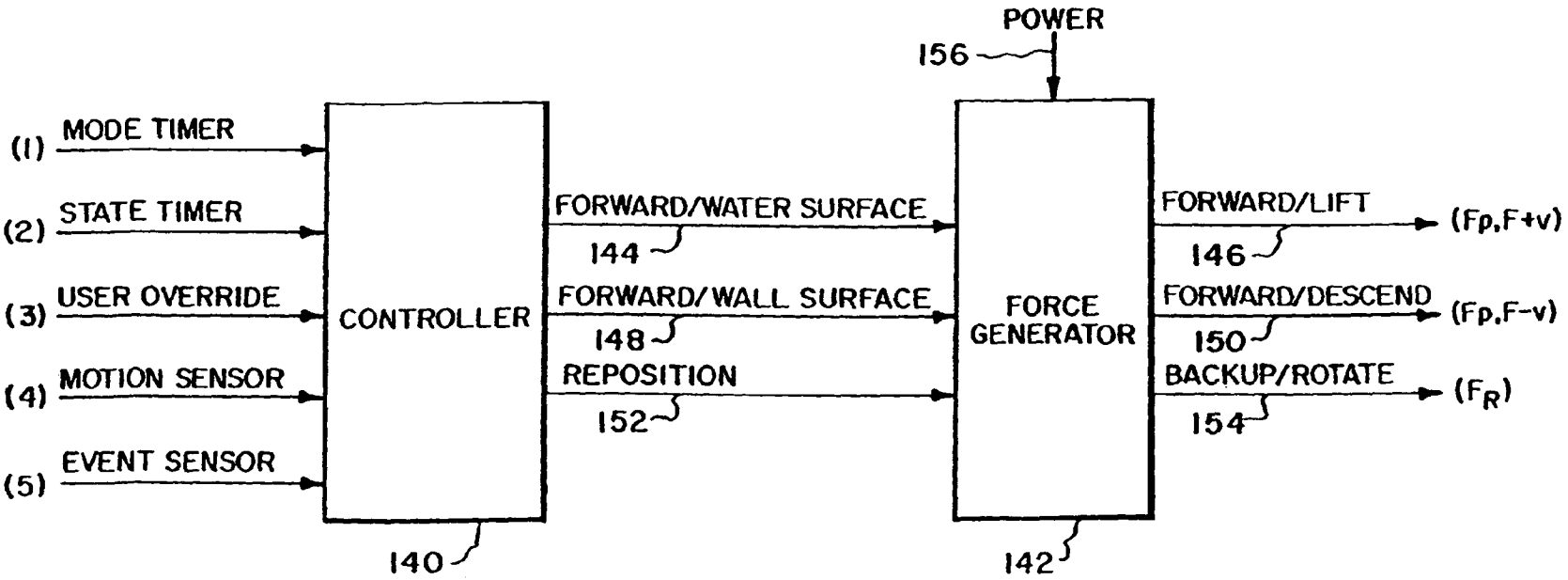
FIG. 5 is a block diagram of an automatic pool cleaner in accordance with the invention showing a control subsystem including a controller responsive to various inputs for controlling a force generator to selectively apply various forces to the cleaner body to establish its operating mode/state.

The present invention is directed primarily to a control subsystem for controlling the respective water discharges from the nozzle outlets depicted in FIGS. 3A-3D and 4A-4D to optimize the performance of the cleaner body. FIG. 5 comprises a functional block diagram depicting such a control subsystem and illustrates a controller 140 for responding to certain input conditions for causing a force generator 142 to selectively generate the aforementioned forces $F_P$, $F_{+V}$, $F_{-V}$, $F_R$ to produce the desired cleaner body motion.

More particularly, controller 140 is responsive to multiple conditional inputs, as depicted in FIG. 5. The depicted inputs include (1) a timed mode change input which switches operation from the wall surface mode to the water surface mode or visa versa. In accordance with an exemplary embodiment to be discussed herein, it will be assumed that a typical operational cycle is comprised of thirteen minutes of wall surface mode operation and seven minutes of water surface mode operation. Controller input (2) in FIG. 5 comprises a timed state change input which in the exemplary embodiment assumed herein occurs at 2.5 minute intervals and typically initiates a reposition operation. Input (3) depicted in FIG. 5 is derived form the position of a manually set mode cam override mechanism. The override mechanism can be manually set by a user to any one of three conditions; i.e., (a) wall surface mode only; (b) water surface mode only; (c) alternating between wall surface mode and water surface mode. Input (4) in FIG. 5 comprises a motion sensor input which will be assumed to be a binary signal indicating whether the rate of cleaner body forward motion is greater than (>) or less than (<) a predetermined threshold rate (T). Input (5) depicted in FIG. 5 is identified as an event sensor and contemplates several alternative input signals which can be derived, for example, from a rotation sensor, a direction sensor, an attitude sensor, etc.

The controller 140 can be electronically and/or mechanically (including hydraulic and pneumatic) implemented. Regardless of the implementation, the controller 140 functions to respond to the set of inputs to generate command signals for the force generator 142. More particularly, the controller can generate a forward water surface command 144 to cause the force generator to produce forward/lift force components 146 ($F_P$, $F_{+V}$). Alternatively, the controller 140 can generate a forward/wall surface command 148 to cause the force generator 142 to produce forward/descend force components 150 ($F_P$, $F_{-V}$). Additionally, the controller 140 can generate a reposition command 152 to cause the force generator 142 to produce backup/redirect force components 154 ($F_R$).

Figure 6:
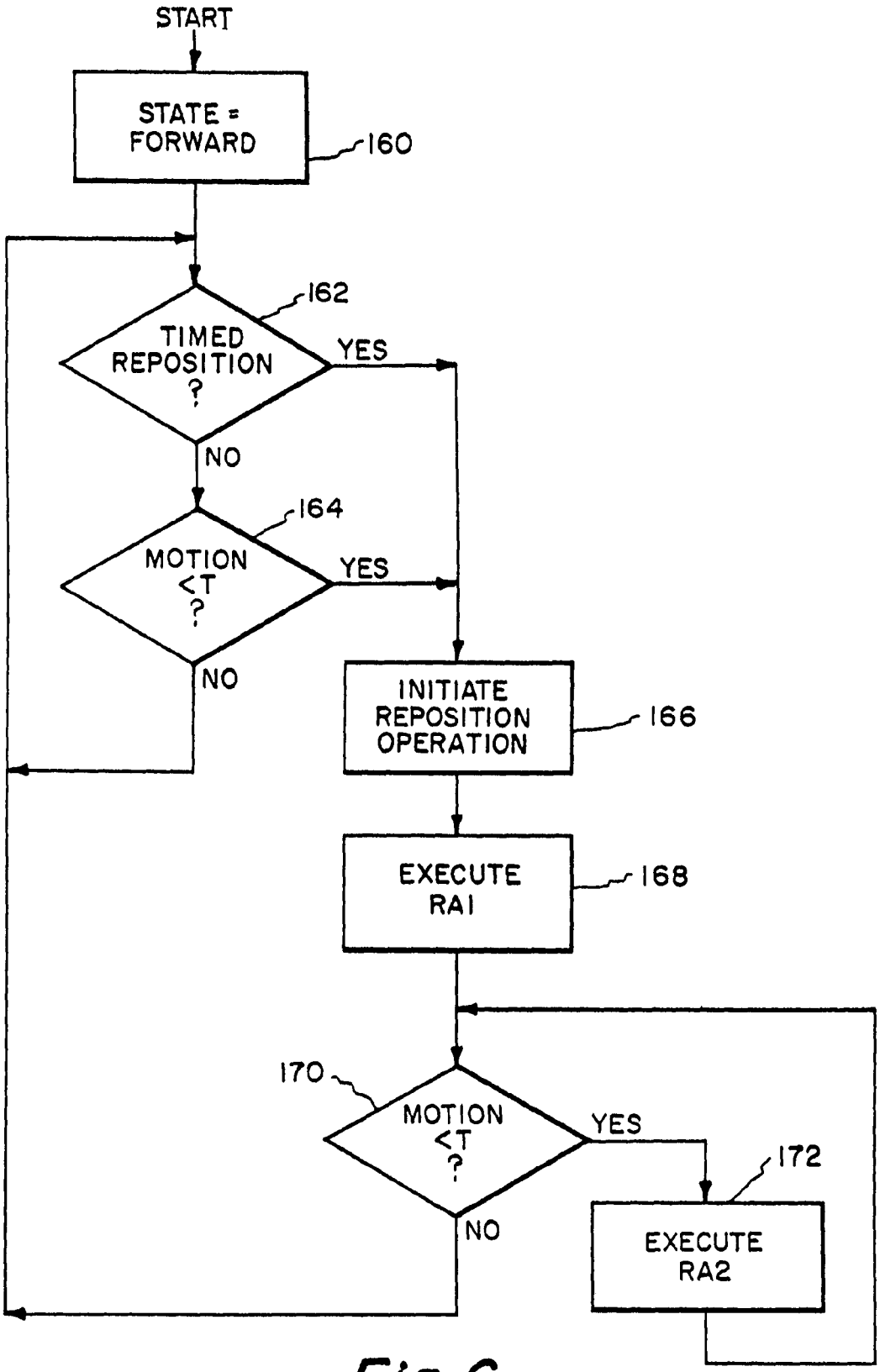
FIG. 6 is a flow chart describing the operation of the controller of FIG. 5 in accordance with an embodiment of the invention in which the cleaner body operates solely in a wall surface mode.

Attention is now directed to FIG. 6 which comprises a flow chart depicting an exemplary routine executable by the controller 140 for a cleaner body operating solely at the wall surface. Execution of the flow chart of FIG. 6 is initiated by a start signal (e.g., supplying positive pressure water to the controller) which enables block 160 to establish a forward state to propel the cleaner body in a forward direction. Thereafter, decision block 162 is executed which determines whether a timed reposition signal has occurred. If NO, operation proceeds to decision block 164 which queries the motion sensor to determine whether the forward motion rate is less than the threshold rate (T). If NO, operation loops back to block 162 and the cleaner body's operation remains in forward state.

On the other hand, if block 162 produces a YES, operation proceeds to block 166 which initiates a reposition operation. Similarly, if the decision block 164 determines that the forward motion rate is less than T, operation would also branch to block 166. In accordance with the present invention, a reposition operation initiated by block 166 is comprised of one, two, or more sequential redirect actions. That is, a first redirect action (RA1) is executed in block 168 to rotate the cleaner body through a first angle. Thereafter, operation proceeds to decision block 170 which asks whether the rate of forward motion is less than the threshold T. If the cleaner body has extricated itself after RA1 and is now exhibiting sustained forward motion, decision block 170 delivers a NO output causing operation to loop back to block 162. On the other hand if decision block 170 delivers a YES, indicating that forward motion has not been sustained, i.e., the cleaner body is likely still trapped by an obstruction, then operation branches to block 172 to execute a second redirect action (RA2). Thereafter, operation branches back to decision block 170 to again check for sustained forward motion.

As will be discussed hereinafter, in accordance with the invention, the initial redirect action (RA1) resulting from block 168 is of a lesser net magnitude than the second redirect action (RA2) resulting from block 172. For example, RA1 can cause the cleaner body to initially rotate 90° whereas RA2 can cause the cleaner body to rotate further to a net angle of 135°

Figure 7:
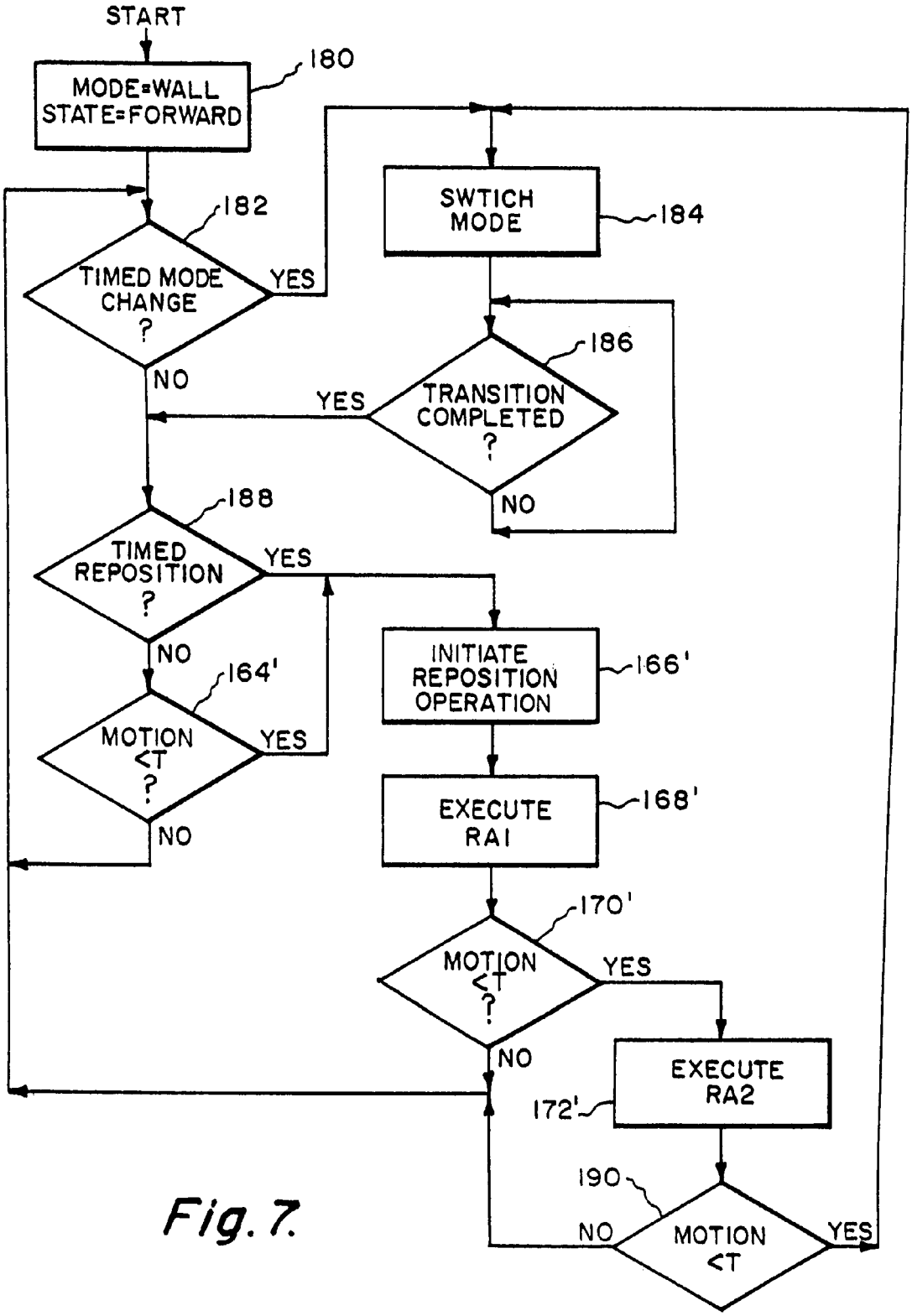
FIG. 7 is a flow chart describing the operation of the controller of FIG. 5 in accordance with an alternative embodiment of the invention in which the cleaner body alternately operates in a wall surface mode and a water surface mode.

Whereas the flow chart of FIG. 6 contemplates cleaner body operation solely at the wall surface, the flow chart of FIG. 7 contemplates operation alternately at the wall surface and at the water surface and functions to assure that a timed reposition operation is not initiated during a transition between the wall surface and the water surface modes. The flow chart of FIG. 7 assumes a start signal which leads to block 180 which, as an example, initializes the system to the wall surface mode and the forward travel state. Decision block 182 is then executed which determines whether a timed mode change input has occurred. If YES, operation proceeds to block 184 to switch the operating mode. Thereafter, decision block 186 is executed to determine whether the mode transition has been completed. For the sake of simplicity, it will be assumed that the transition has been completed within a predefined transition interval, e.g., 75 seconds, after the mode is switched in block 184. Accordingly, operation will loop around decision block 186 until the transition interval has expired. Once the transition interval expires, then operation branches from block 186 to decision block 188. Similarly, if decision block 182 delivers a NO to indicate that a timed mode change input has not occurred, operation will branch to decision block 188. It should be recognized that decision block 188 corresponds to decision block 162 of FIG. 6. The subsequent blocks in FIG. 7 and resulting actions are substantially identical to those discussed in FIG. 6 except for one important distinction. In FIG. 7, after execution of a certain number of redirect actions, e.g., RA2 in block 172, if forward motion is not sustained (sensed in block 190), then operation loops back to block 184 to switch the operating mode.

Figure 8:
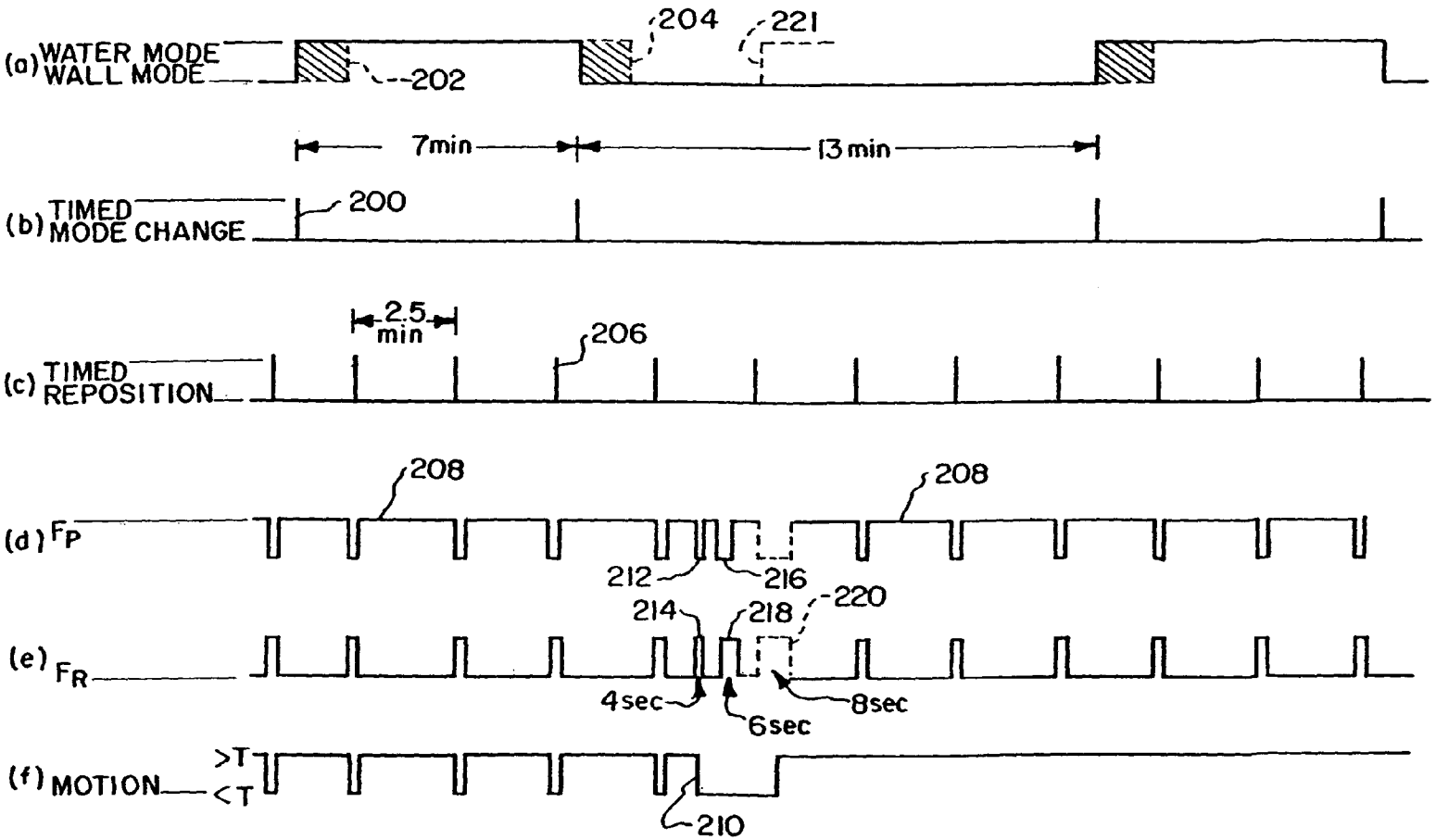
FIG. 8 is a timing chart device depicting the relationship between various events associated with the initiation and execution of an exemplary repositioning operation.

Attention is now directed to FIG. 8 which comprises a timing chart to help explain the operation of a preferred control subsystem operating in accordance with FIG. 7. FIG. 8 assumes an exemplary subsystem having a 20 minute operational cycle during which the water surface mode is defined for 7 minutes and the wall surface mode is defined for 13 minutes. Line (b) of FIG. 8 depicts mode change triggers 200 which occur at the 7 and 20 minute marks of each cycle to switch cleaner body modes as represented in line (a). Also, note that line (a) represents mode transition intervals, e.g., 202, 204, which will be assumed to have a 75 second duration, during which time initiated reposition operations are to be avoided. Line (c) depicts timed reposition triggers 206 which in the exemplary embodiment are spaced by 2.5 minutes. Except during a mode transition interval, each of these timed reposition triggers initiates a reposition operation to facilitate randomization of the body's travel path. To prevent the initiation of a reposition operation during a mode transition interval, the timed reposition triggers 206 (line (c)) have been intentionally phased relative to the timed mode change triggers 200 (line (b)) to assure that no reposition triggers occurs during a mode transition interval, e.g., 202, 204. Lines (d) and (e) respectively show the propulsion force intervals 208 which occur normally as a consequence of the timed reposition triggers 206 outside of the mode transition intervals.

Line (f) of FIG. 8 shows the outlet of a motion sensor which indicates whether the body's rate of forward motion is greater than a threshold rate (>T) or less than the threshold rate (<T). It will be recalled form FIGS. 6 and 7, that a reposition operation is initiated when the <T condition is recognized. This situation is depicted at 210 in FIG. 8, line (f). As a consequence, a first redirect action RA1 is initiated to suspend the propulsion force $F_P$ (at 212) and produce the reposition force $F_R$ (at 214). It will be recalled that RA1 is intended to produce a relatively small angular rotation, e.g., 90° which can typically be produced, for example, by a short duration force, e.g., 4 seconds. RA1 is then terminated after the desired rotation is achieved or at the end of the specified short duration. If sustained forward motion fails to occur after RA1, a second redirect action RA2 is executed to suspend the force $F_P$ (at 216) and produce a larger angular rotation, e.g., net 135° which can typically be produced by a longer duration force $F_R$ (at 218), e.g., 6 seconds. RA2 is then terminated after the desired rotation is achieved or the specified duration has expired. In most circumstances, the first and second redirect actions will free the body form the obstruction to produce sustained forward motion. However, the system can be configured to execute one or more further redirect actions, e.g., reposition force $F_R$ (at 220) having an 8 second duration, can be produced. If sustained forward motion fails to occur after a certain number (e.g., 2, 3, or 4) of redirect actions, then the mode is switched (shown at 221) as has been explained in connection with FIG. 7.

Figure 9A:
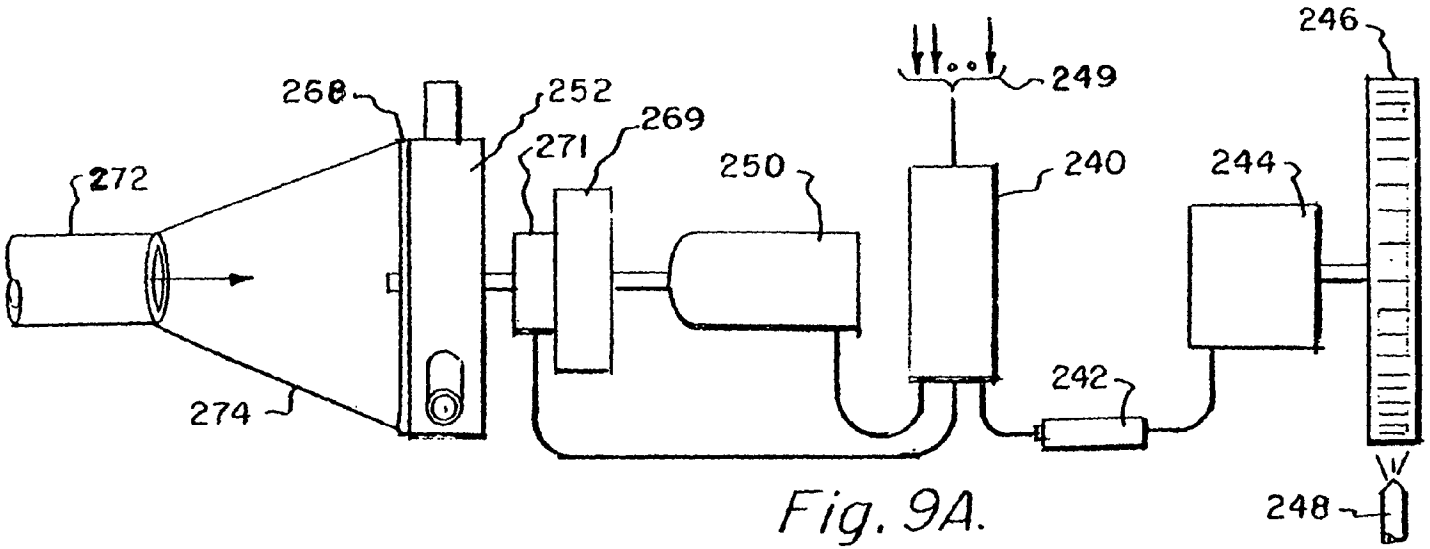
FIG. 9A is a schematic diagram of a first exemplary control subsystem implementation in accordance with the invention which can use an electronic controller to control a rotary valve and FIG. 9B is a perspective exploded view of a suitable rotary valve.
Figure 9B:
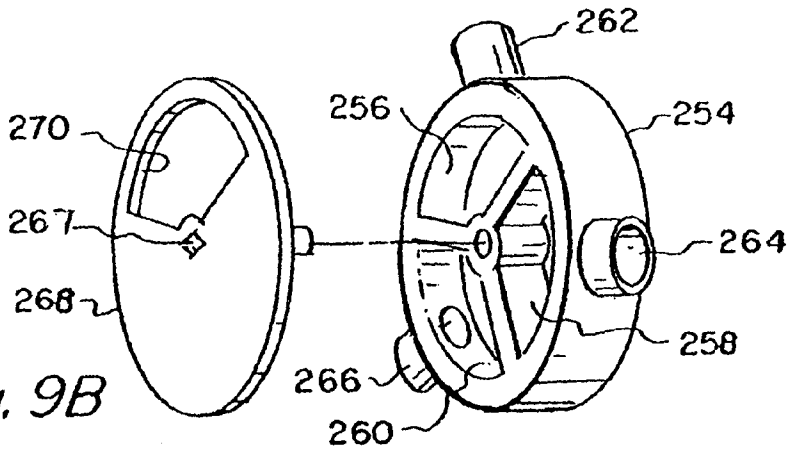

Attention is now directed to FIGS. 9A and 9B which illustrate a first exemplary implementation of a control subsystem in accordance with the invention as depicted in FIGS. 5-8. FIG. 9A depicts a controller 240 corresponding to controller 140 of FIG. 5. Controller 240 preferably includes microprocessor based electronics which can be powered by battery 242. The battery can be charged by a generator 244 driven by a turbine 246 rotated by a water jet 248 derived from a positive pressure source, e.g., pump 10 of FIG. 1. The controller 240 responds to multiple inputs (see FIG. 5) 249 to control a motor 250 to selectively set a three position rotary valve 252. The valve 252 is comprised, as shown in FIG. 9B of a valve body 254 defining three isolated chambers 256, 258, 260. The chambers respectively communicate with outlets 262, 264 266. A valve element 268 overlays and seals the chambers and is mounted for rotation around axis 267. Motor 250 rotates valve element 268 via gear reducer 269 to position valve port 270 over a selected one of the chambers. Position sensor 271 can report the position of element 268 back to the controller 240. The valve port 270 opens the selected chamber to a power source, e.g., positive pressure water supplied via tube 272 through shroud 274. The outlets 262, 264, 266 respectively produce water jets to develop the three respective force sets represented at the output of the force generator 142 in FIG. 5.

Figure 10:
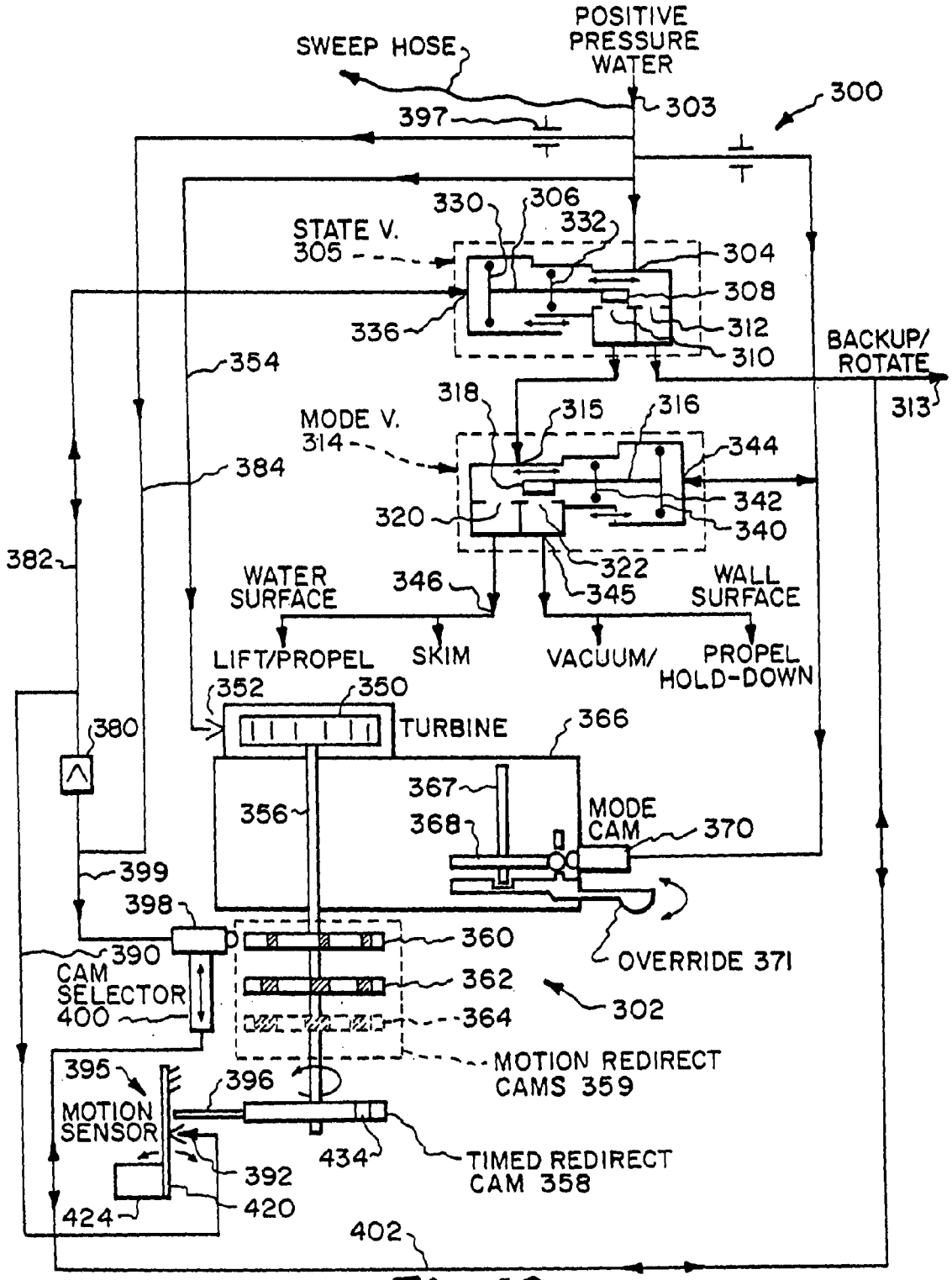
FIG. 10 is a schematic diagram of a second exemplary control subsystem implementation in accordance with the invention employing a hydraulic controller.

Attention is now directed to FIG. 10 which schematically illustrates an exemplary control subsystem 300 using a hydraulic controller 302. The subsystem 300 is supplied with high pressure water at inlet 303 (e.g., from pump assembly 10 of FIG. 1). The water flow at inlet 303 is directed to the inlet 304 of a two port state valve assembly 305. The assembly 305 includes a valve actuator 306 configured to move a valve element 308 between a first position (to the right as viewed in FIG. 10). When in the left position, the valve element 308 closes port 310 and opens port 312. Water flow from inlet 304 through port 312 is delivered to a backup/redirect nozzle 313 for producing the backup/redirect force $F_R$. When in the right position, the valve element 308 opens port 310 and closes port 312. Water flow through port 310 is delivered to the inlet 315 of a two port mode valve assembly 314.

The assembly 314 includes a valve actuator 316 configured to move a valve element 318 between a left position and a right position. When in the right position, port 320 is open and port 322 is closed. Port 320 delivers water flow for producing the lift/propulsion force components ($F_{+V}$, $F_P$) for operation in the forward state water surface mode. When the valve element 318 is in the left position, port 320 is closed and port 322 is open. Port 322 delivers water flow for producing the forward/descend force components ($F_{-V}$, $F_P$) for operation in the forward state wall surface mode.

The state valve actuator 306 includes a piston mounted for reciprocal linear motion. The piston has oppositely directed first and second faces 330, 332 with the area of face 330 being larger than the area of face 332. Thus, as is explained in aforementioned application PCT/US2004/16937, a positive pressure applied only to face 332 will move the valve element 308 to the left but positive pressure applied to face 330 will move the valve element 308 to the right. In operation, positive pressure water is continually applied to face 332 via inlet 304 from supply inlet 303. On the other hand, positive pressure water is selectively applied to face 330 via control port 336 by controller 302. When positive pressure water is applied to control port 336, the valve element 308 moves right to supply, via port 310, positive pressure water to inlet 315 of the mode valve assembly 314. This positive pressure flow into inlet 315 is directed out though either port 320 or 322 dependent on the position of valve element 318 mounted on mode valve element 318 mounted on mode valve actuator 316.

The mode valve actuator 316 similarly includes a piston mounted for reciprocal linear motion and similarly has oppositely directed first and second faces 340, 342 with the area of face 340 being larger than the area of face 342. When positive pressure water is supplied to control port 344, the valve element 318 moves left to open port 322 to produce an outflow at exit 345 for forward propulsion in the wall surface mode. When positive pressure is not available at control port 344, the valve element 318 moves right to open port 320 to produce an outflow at exit 346 for forward propulsion in the water surface mode.

Control ports 336 and 344 are controlled by controller 302. Controller 302 is schematically depicted in FIG. 10 with exemplary implementation details being shown in FIGS. 11-15. The controller 302 is comprised of a turbine 350 driven by a jet 352 supplied with positive pressure water via line 354. The turbine 350 rotates a shaft 356 carrying a timed redirect cam 358 and a bank 359 of two or more motion redirect cams, e.g., 360, 362, 364. A gear train (not shown) in housing 366 is also driven by the turbine 350 to rotate shaft 367 carrying a mode cam 368. Thus, the cams 358, 360, 362, 364, 368 all rotate synchronously. Unless otherwise stated, it will be assumed herein that the exemplary embodiment to be discussed, a) the mode cam 368 has a 20 minute cycle and two spaced discontinuities for generating timed trigger signals at the beginning/end of each cycle and at the 7 minute mark;

b) the timed redirect cam 358 has a 2.5 minute cycle and a single discontinuity for generating trigger signals spaced by 2.5 minutes; and c) each motion redirect cam 360, 352, 264 has a 2.5 minute cycle and eight lobes.

A preferred mode cam 368 implementation will be discussed in detail in connection with FIGS. 13A, 13B, 13C, 13D. It will suffice at this point to understand that as cam 368 rotates, it opens a normally closed mode control valve 370 for 7 minutes of each 20 minute cycle. When valve 370 is closed, the positive pressure water form supply inlet 303 is applied to control port 344 to move valve element 318 left. This supplies a positive pressure flow out of exit 345 for producing force components for forward propulsion in the wall surface mode. When valve 370 is open, the control port 344 is deprived of positive pressure water from inlet 303 thus enabling the valve element 318 to move right for supplying a flow out of exit 346 to produce force components for forward propulsion in the water surface mode. FIG. 10 also shows a user override control mechanism 371 which can be manually set to permit operation (1) solely in the wall surface mode or (2) solely to the water surface mode or (3) alternately in the wall surface and water surface modes.

The state valve control port 336 selectively receives positive pressure water from check valve 380 and flow path 384. Positive pressure water is supplied to the check valve 380 via flow path 382. In order to initiate a reposition operation and supply positive pressure water to the backup/redirect nozzle 313, the flow to or out of the check valve 380 is diverted. More particularly, note flow path 390 extending from the output of check valve 380 to a relief port 392. As will be discussed with reference to FIGS. 11A, 11B, 11C the relief port 392 is held closed when the cleaner body is traveling at a forward rate >T by a motion sensor mechanism 395. With relief port 392 closed, check valve 380 can supply positive pressure to control port 336 to maintain the state valve in the forward state. The timed redirect cam 358 (by virtue of lever arm 396) opens the relief port 392 every 2.5 minutes to interrupt the positive pressure at control port 336 and thus initiates a reposition operation as previously discussed in connection with FIGS. 6-8.

As previously noted, flow path 384 supplies a positive pressure via check valve 380 to control port 336 to move valve element 308 right to place valve 305 in the forward state. This path includes a small orifice 397 which communicates pressure but limits the magnitude of water flow. A ball valve 398 is coupled to the upstream side of check valve 380. If the ball 398 opens and motion sensor relief port 392 opens (which will occur if cleaner body motion is <T), then the check valve 380 will fail to deliver sufficient positive pressure to control port 336 to maintain the actuator to the right, i.e., the forward state.

More particularly, consider the situation in which the cleaner body is moving forward at a rate >T with relief port 392 closed. Now assume that the body encounters an obstruction which reduces its forward rate to <T thus opening the relief port 392. This action alone is insufficient to deprive control port 336 of positive pressure. However, when ball valve 398 is next opened, e.g., by a lobe on cam 360, then the control port 336 will be deprived of pressure and the state valve 305 will switch to initiate a reposition operation.

As will be discussed in greater detail in connection with FIGS. 12A, 12B, 12E, a cam selector 400 is associated with the ball valve 398 to assure that each reposition operation is initiated using the first motion redirect cam 360 to execute a first redirect action RA1. The cam 360 has the shortest duration lobes, e.g., sufficient to hold the ball valve 398 open for 4 seconds. If this first redirect action RA1 is sufficient to produce a sustained forward motion rate >T, the motion sensor mechanism 395 will close relief port 392 thus terminating the reposition operation. However, if the body's forward motion is insufficient to close port 392, then the cam selector 400, controlled by a pressure online 402 from state valve port 312, will associate ball valve 398 with the next motion redirect cam 362 to perform a second redirect action RA2. Cam 362 has longer duration lobes than cam 360, e.g., sufficient to hold the ball valve open for 6 seconds, to increase the body's turning angle.

Figure 11A:
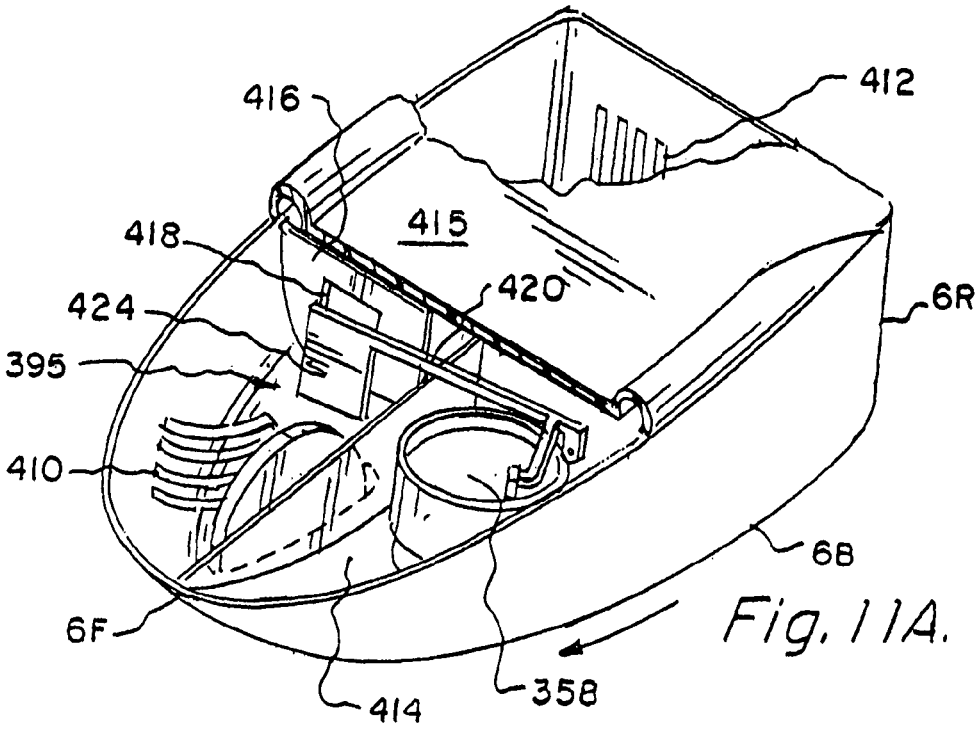
FIGS. 11A, 11B, 11C depict a preferred motion sensing mechanism useful in the subsystem of FIG. 10.
Figure 11B:
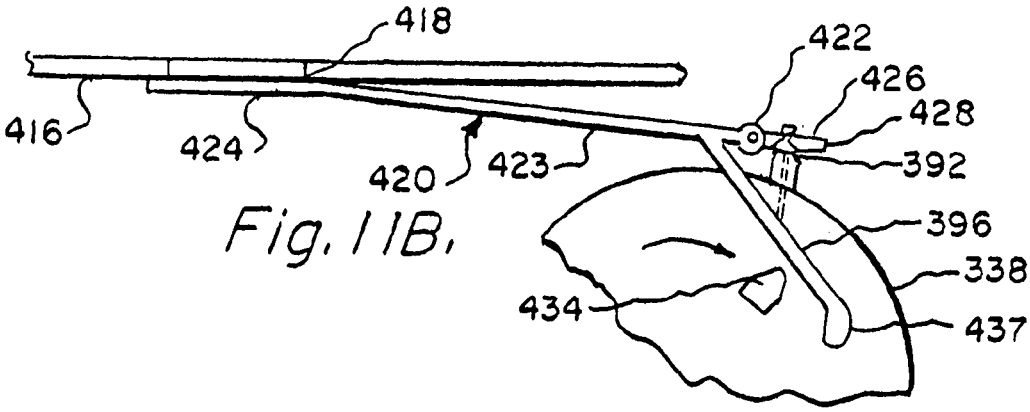
Figure 11C:
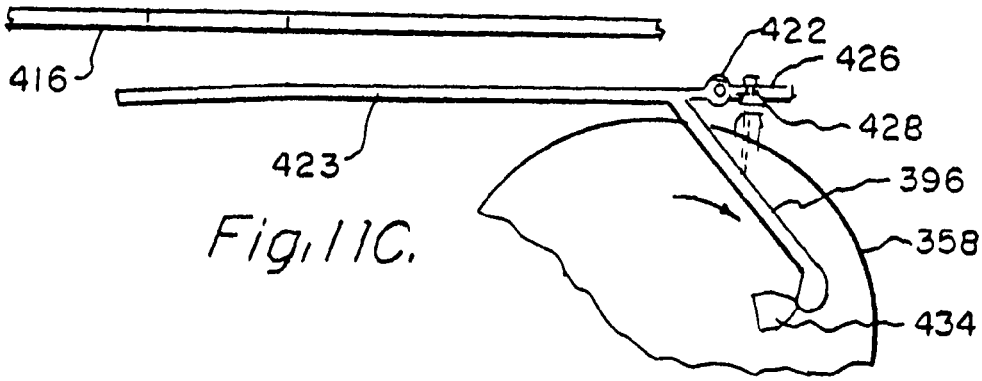

Attention is now directed to FIGS. 11A, 11B, 11C, which show a preferred implementation of the timed redirect cam 358 and the motion sensor mechanism 395 schematically depicted in FIG. 10. FIG. 11A is a prospective representation of the bottom portion 6B of a cleaner body housing having a front or nose portion 6F and a rear or tail portion 6R. Note that inlet vents 410 are provided on the housing front portion 6F and outlets vents 412 are provided on the housing rear portion 6R. As a consequence, as the cleaner body moves through the pool in a forward direction, pool water will move rearwardly through the body cavity 414 below the deck from the inlet vents to the outlet vents 412.

In accordance with a preferred implementation of the motion sensor mechanism 395, a channeling means, e.g., a partition 416 having a window 418, is provided in the body cavity 414 to channel most of the water moving through the cavity through the window 418. A motion sensor arm 420 is mounted for pivotal movement around pin 422. The arm 420 includes a long front portion 423 which carries a paddle 424 aligned with the window 418.

When the body is moving forward at a rate greater than a threshold T, water movement through the body cavity 414 will bear on the paddle 424 to pivot arm 420 to the clockwise position shown in FIG. 11B. The arm 420 also includes a short rear portion 426 which carries a seal 428 which is aligned with the aforementioned relief port 392 (FIG. 10).

When the body's rate of forward motion is sufficient to force the paddle 424 and arm 420 to the clockwise position (FIG. 11B), the arm rear portion 426 presses the seal 428 against the relief port 392 to close it. The long length of arm front portion 423 relative to the short length of arm rear portion 426 affords a sufficient moment arm to assure that relief port 392 can be well sealed.

It will be recalled that the timed redirect cam 358 in FIG. 10 is operable to open relief port 392 every 2.5 minutes. FIGS. 11A, 11B, 11C show a preferred implementation wherein the cam 358 carries a protruding lobe 434 located to engage lever arm 396 attached to the motion sensor arm 420. As the cam 358 rotates clockwise (FIGS. 11B, 11C), the lobe 434 will engage a projection 437 on lever arm 396 to pivot arm 420 counterclockwise (FIG. 11C) to move the seal 428 and thus open relief port 392. After the lobe 434 moves past projection 437, the position of the arm 420 will again be determined by the water bearing against paddle 424 in cavity 414.

Figure 12A:
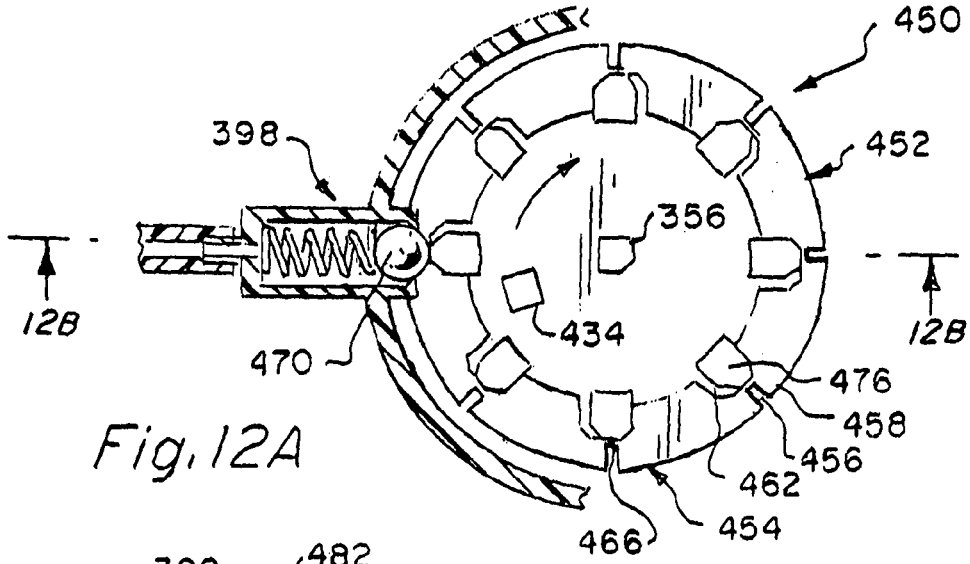
FIGS. 12A and 12B respectively comprise a top view and a side sectional view of a preferred configuration of multiple state cams useful in the subsystem of FIG. 10.
Figure 12B:
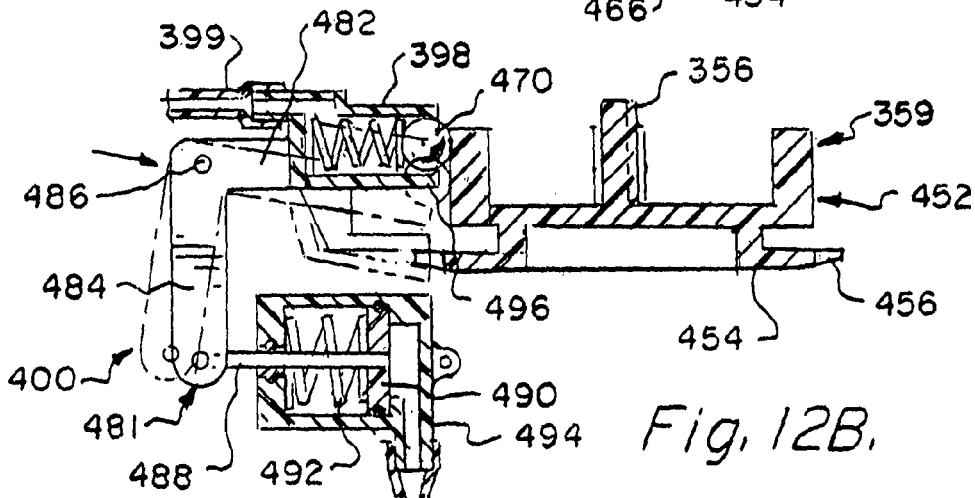
Figure 12C:
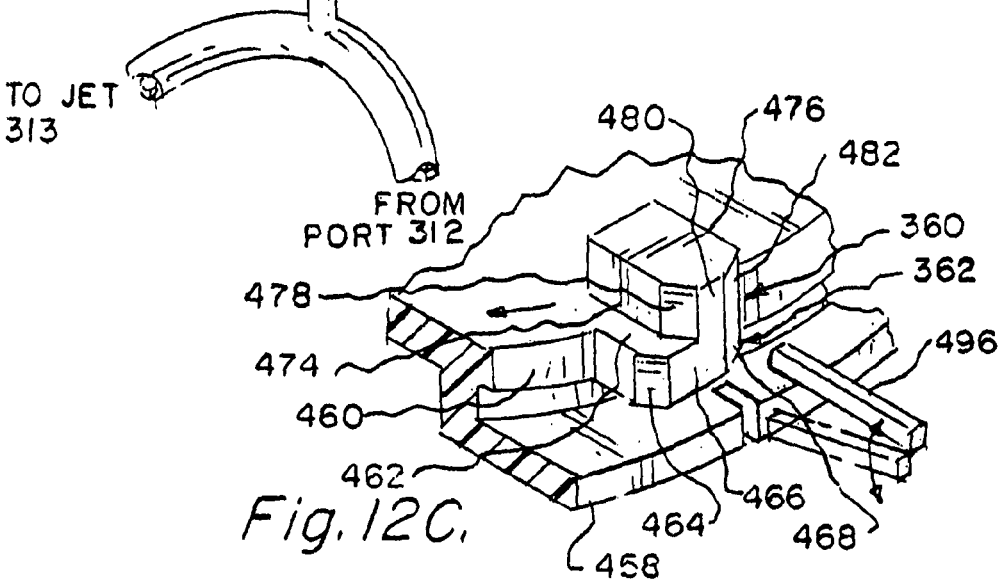
FIG. 12C is an enlarged fragmentary perspective view showing exemplary lobes on the state cam configuration of FIGS. 12A and 12B, together with a follower mechanism for selecting which of multiple state cams to use.

Attention is now directed to FIGS. 12A, 12B, 12C which illustrates a preferred implementation 450 of the motion redirect cam bank 359 and cam selector 400 of FIG. 10. Whereas the schematic diagram of FIG. 10 depicts the cam bank 359 as including two (360, 362) or more (e.g., 364) cams mounted on a common drive shaft 356, the implementation 450, for simplicity in explanation, shows only cams 360 and 362.

It will be recalled that the cam 360 in an exemplary embodiment is comprised of eight short duration lobes each of which defines a four second interval whereas the cam 362 has eight longer duration lobes each of which defines a six second interval. In the implementation 450 of FIGS. 12A, 12B, 12C, each of these cams is defined on the periphery of a different level of multilevel cam assembly 452 which can be integrally formed. The cam assembly 452 is mounted on and rotated by shaft 356 in a clockwise direction as viewed in FIG. 12A.

The assembly 452 includes a lower level shelf 454 having radial slots 456 extending inwardly from a peripheral edge 458. Eight slots 456 are provided uniformly spaced around the peripheral edge 458. The assembly 452 further includes a middle level peripheral edge 460 having eight uniformly spaced lobes 462 projecting radially outward therefrom. Each lobe 462 includes an entrance ramp surface 464, a valve activating surface 466, and an exit ramp 468. The valve activating surface 466 is located to engage ball 470 to open valve 398. The length of the surface 466 along the peripheral edge 460 defines the interval duration during which the ball valve 398 stays open (six seconds in the exemplary embodiment).

The assembly 452, as shown in FIGS. 12A, 12B, 12C also includes an upper level peripheral edge 474 having eight uniformly spaced lobes 476 projecting radially outward therefrom. Each lobe 476 includes an entrance ramp surface 478, a valve activating surface 480, and an exit ramp surface 482. The valve activating surface 480 has a length along the peripheral edge 474 to engage ball 470 to hold the valve 398 open for an assumed four second interval.

The cam selector mechanism 400 is provided to initially align the ball 470 with the upper level peripheral edge 474 for executing a first redirect action RA1 of a reposition operation. If RA1 fails to provide sustained forward motion, then the mechanism 400 moves the ball 470 into alignment with the middle level peripheral edge 460 to execute a second redirect action RA2. The cam selector mechanism 400 includes a right angle link 481 comprised of first and second arms 482, 484. The first arm 482 carries the ball valve 398. The second arm 484 is attached to shaft 488 of piston 490. The link 481 is mounted for pivotal movement about the vertex 486 between a normal (counterclockwise) position shown in solid line in FIG. 12B and an activated (clockwise) position shown in phantom line. When in its normal solid line position, the ball 470 is positioned to engage the upper level lobes 476 which form the cam 360 of FIG. 10. When in the clockwise phantom line position, the ball 470 is positioned to engage the middle level lobes 462 which form the cam 362 of FIG. 10.

The piston 490 is normally held to the right as viewed in FIG. 12B by spring 492 to position the link 481 in the normal solid line position. However, pressure from port 312 (FIG. 10) applied to piston 490 via tube 494 produces a force on arm 484 tending to pivot the link 481 to its phantom line position to align ball 470 with the middle level lobes 462. A projecting finger 496 mounted on the front end of link arm 482 bears against the upper surface of shelf 454 and prevents the link 481 from pivoting to the phantom line position until a slot 456 moves into alignment with the finger 496. When this occurs, the finger 496 falls through the slot 456 and allows the link 481 to pivot clockwise (FIG. 12C) to move ball 470 into alignment with the middle level lobes 462 which are used to initiate the second redirect action RA2. If RA2 produces sustained forward body motion, the pressure from port 312 is relieved allowing the spring 392 to pivot the link 480 counterclockwise to return to the normal full line position when a slot 456 next moves into alignment with finger 496.

Figure 13A:
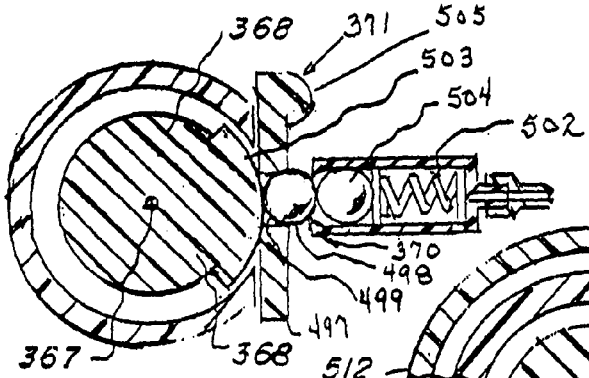
FIG. 13A illustrates a simple manual override mechanism which permits a user to restrict operation to solely wall surface, solely water surface or alternatively wall surface/water surface.

Attention is now directed to FIG. 13A which illustrates a simplified manual override control 371 (FIG. 10) for controlling the mode control valve, i.e., ball valve 370. Briefly, the override control 371 in FIG. 13A is comprised of a member 497 which can be linearly manually moved to any one of three vertical positions. In the middle position as shown in FIG. 13A, member 497 positions an actuator element 498 held captive in recess 499, in alignment with control element 504 of the ball valve 370. In this middle position, a high portion 503 of the rotatable mode cam 368 is able to periodically engage the actuator element 498 to force it against control element 504 to open the valve 370. Member 497 can be manually pulled down to a second position (not shown) to align a protuberance 505 with the control element 504 to hold the valve 370 open regardless of the action of the mode cam 368. Alternatively, the member 497 can be manually moved upward from the position shown in FIG. 13A so that nothing bears against control element 504 thereby leaving the valve 370 in its normally closed condition.

Attention is now directed to FIGS. 13B, 13C, 13D, 13E which illustrate a preferred implementation of the manual override control 371 (FIG. 10) for controlling the ball valve 370. The ball valve 370 is normally closed by spring 502 bearing against ball 504 to seat it against ridge 506. As will be recalled from FIG. 10, when valve 370 is closed, the body 6 operates in the wall surface mode. When valve 370 is open, the body operates in the water surface mode. The mode cam 368 is mounted on and rotated by shaft 367. Cam 368 defines an annular periphery 510 comprised of a low portion 512 and a high portion 514. In order to produce thirteen minutes of wall surface mode operation and seven minutes of water surface mode operation during each 20 minute cycle, the low portion 512 extends over 65% of the periphery 510 and high portion extends over 35%.

A rotatable ring cage 520 is mounted concentrically around mode cam 368 for retaining a ball 522 in cage opening 523. The rotational positional of the cage 520 is set by a manually operable user handle 524. A cylindrical housing 526 is mounted around the cage 520 to contain the ball 522 in opening 523.

Figure 13B:
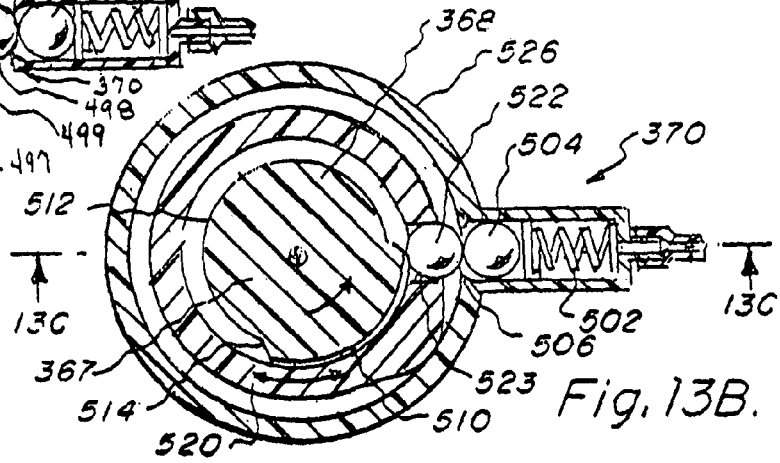
FIGS. 13B and 13C respectively comprise side and top sectional views of a preferred mode cam configuration and manual override mechanism, useful in the cleaner of FIG. 10, showing the override mechanism in a position to permit the cleaner body to automatically operate alternately in the wall surface and water surfaces modes.
Figure 13C:
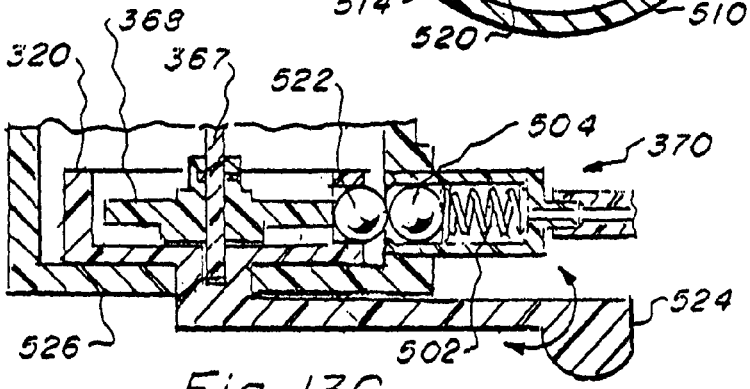
Figure 13D:
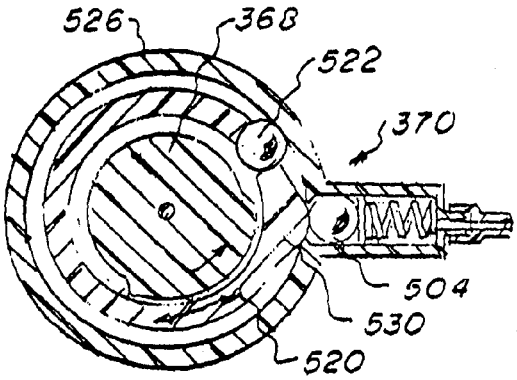
FIGS. 13D and 13E comprise side sectional view of the mode cam of FIGS. 13A and 13B respectively showing the cam in the (1) wall surface only and (2) water surface only rotary positions.
Figure 13E:
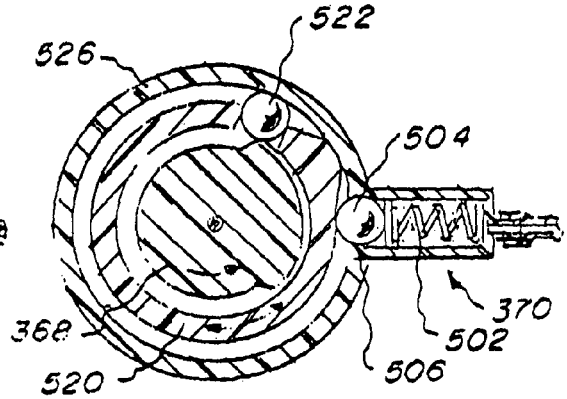

FIGS. 13B, 13D, 13E respectively show the three distinct rotational positions of cage 420 which can be set by a user to respectively cause the body 6 to (1) operate alternately in the water surface mode and wall surface modes, (2) operate solely in the water surface mode, or (3) operate solely in the wall surface mode.

More particularly, FIG. 13B shows the ring cage 420 positioned to align ball 522 with ball 504 of valve 370. In this position of the cage, when the periphery high portion 514 of cam 368 rotates ball 522, it moves ball 504 axially to open valve 370. However, as cam 368 rotates to move the periphery low portion 512 adjacent ball 522, it permits spring 502 to force ball 504 against ridge 506 to close the valve 370. Thus, with the cage position depicted in FIG. 13B, the state of the ball valve alternately opens and closes as the mode cam 368 rotates.

Attention is now directed to FIG. 13D which shows the cage 520 in a position to assure that the valve 370 remains open regardless of the orientation of the mode cam 368. More particularly, note that the periphery of cage 520 includes a protrusion or bulge 530 which engages ball 504 to axially move the ball to open valve 370. Thus with the cage set by handle 524 to the position shown in FIG. 13D, the valve 370 will remain open causing the body 6 to operate solely in the water surface mode.

FIG. 13E shows the cage 520 in a position which permits spring 502 to force ball 504 against housing ridge 506 to maintain valve 370 closed regardless of the rotational position of mode cam 369. When in the position illustrated in FIG. 13E, the valve 370 remains closed thereby restricting the operation of body 6 to the wall surface mode.

It should now be recognized that the timed mode change triggers 200 of FIG. 8 coincide with the opening and closing of valve 370 (FIG. 13A) as a consequence of the rotation of the mode cam 368. It should also be recognized that the timed reposition triggers 206 of FIG. 8 occur when a lobe (462, 476) of cam assembly 452 (FIG. 12A) presses against ball 470.

Figure 14A:
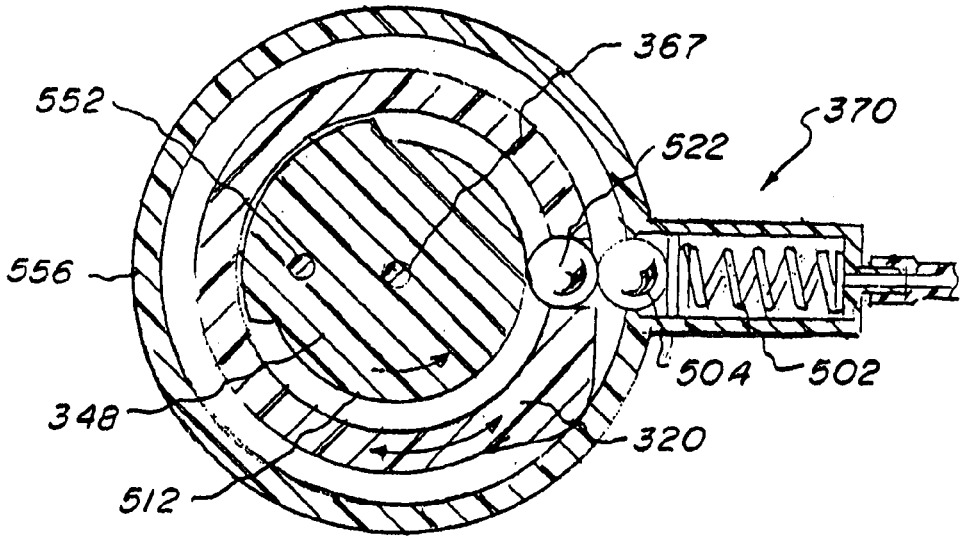
FIGS. 14A, 14B show the relative positioning of the state and mode cams to assure that a timed reposition operation is not initiated during a mode transition.
Figure 14B:
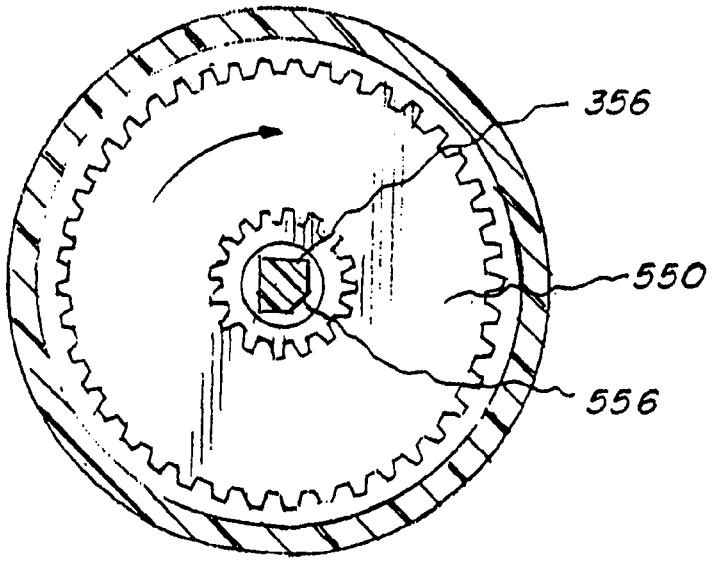
Figure 15A:
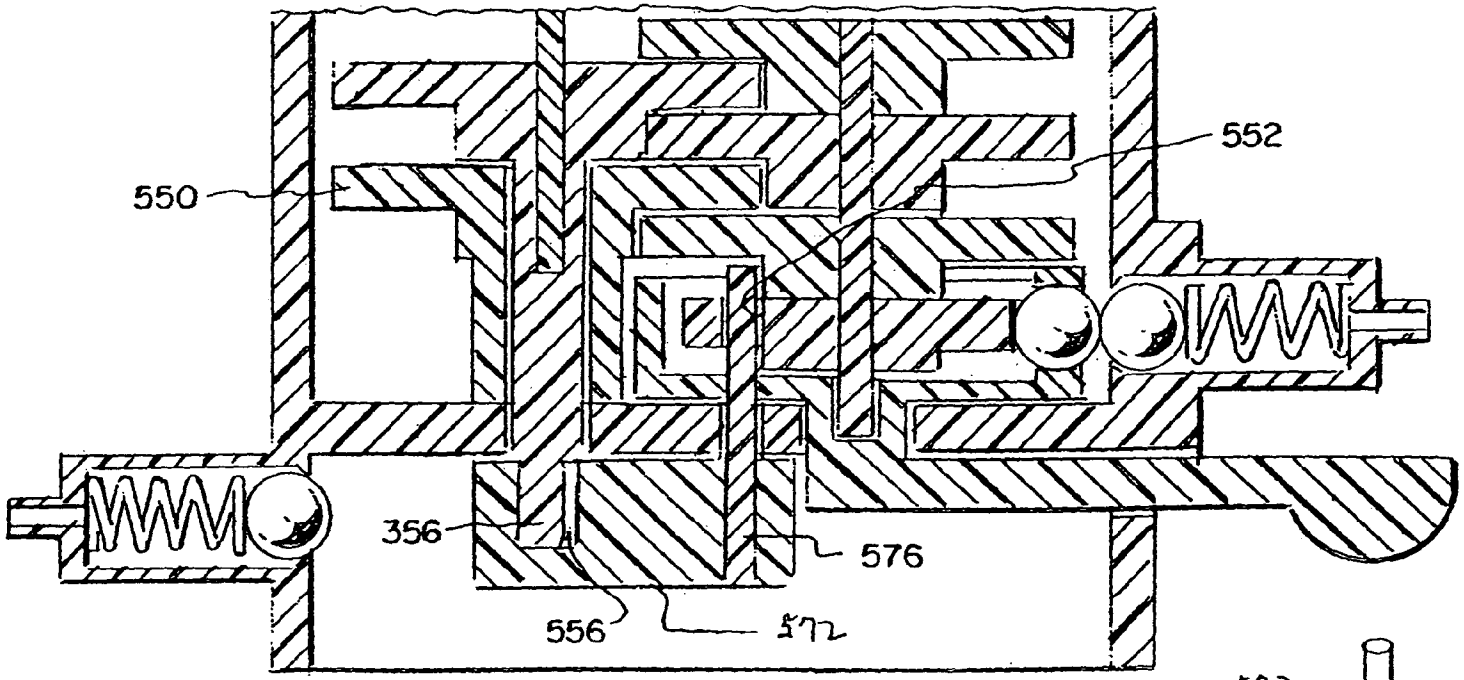
FIGS. 15A and 15B depict a fixture useful during the assembly of a gear train of the preferred hydraulic controller of FIG. 10 to assure proper relative phasing of the state and mode cams as depicted in FIGS. 14A, 14B.
Figure 15B:
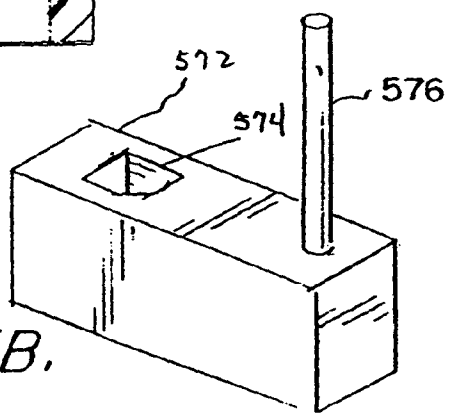

It will be recalled from the discussion of FIG. 8 that it is preferable to phase the timed reposition triggers 206 relative to the timed mode change triggers 200 to assure that no timed reposition trigger occurs during a mode change interval. This preferred phasing is achieved in accordance with the present invention by appropriate installation of the mode cam 368 relative to the state cam assembly 452 at the time of manufacture. More particularly, as shown in FIG. 14A, the mode cam 368 is provided with a registration hole 552 and the shaft 356 which is used to drive the state cam assembly 452 is keyed at 556 to only accept the assembly 452 (FIG. 12A) in a particular rotational orientation. By properly phasing the shaft key 556 relative to the registration hole 552, the timed reposition triggers 206 (FIG. 8) will fall outside of the mode change intervals, e.g., 202, 204.

In order to properly phase hole 552 and shaft key 556, a fixture 572 (FIGS. 15A, 15B) is provided containing a keyed shaft recess 574 and carrying a registration pin 576. In use (FIG. 15A), the cam 368 is manually rotated until fixture 572 accepts keyed shaft 356 in recess 574 and pin 576 is accepted into registration hole 572. This relative phasing of mode cam 368 and shaft 356 will assure proper phasing to avoid the occurrence of timed reposition triggers during mode change intervals. Once the shaft position has been set, fixture 572 can be removed and the keyed state cam assembly 452 can be mounted on the shaft and it will automatically be properly phased relative to mode cam 368.

Figure 16B:
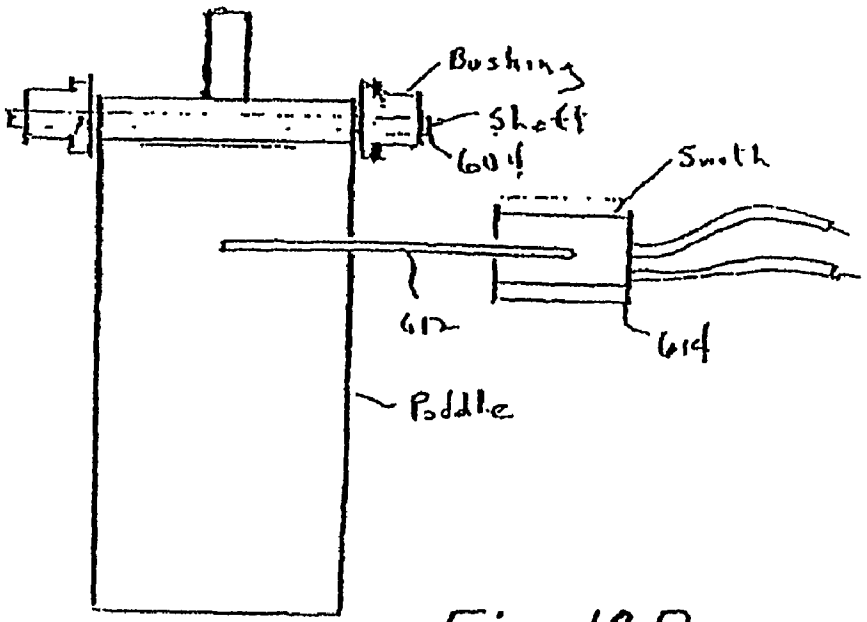
FIGS. 16A and 16B respectively comprise side and front views of an alternative motion sensor mechanism for producing an electric output signal representing forward body motion.
Figure 16A:
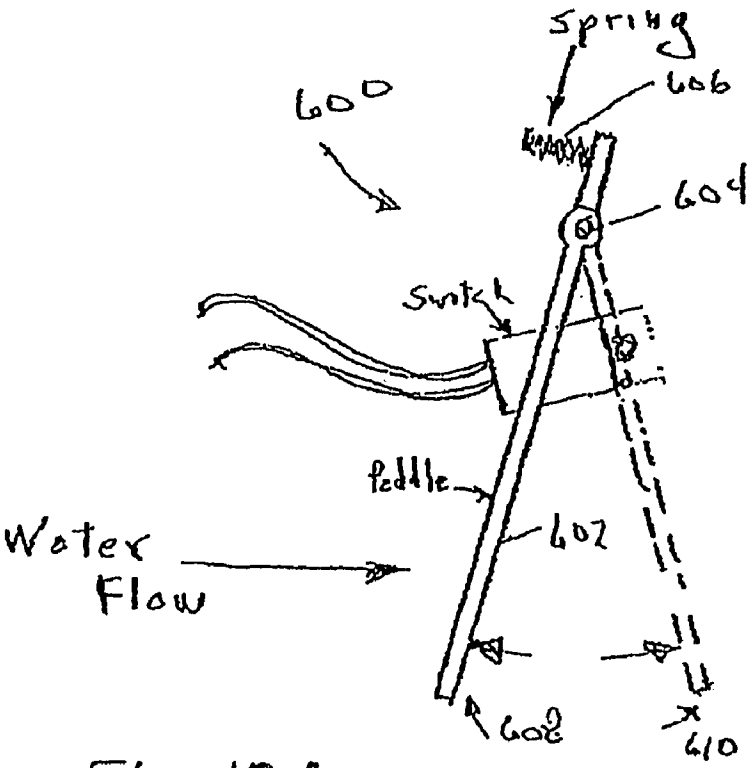
Figure 17B:
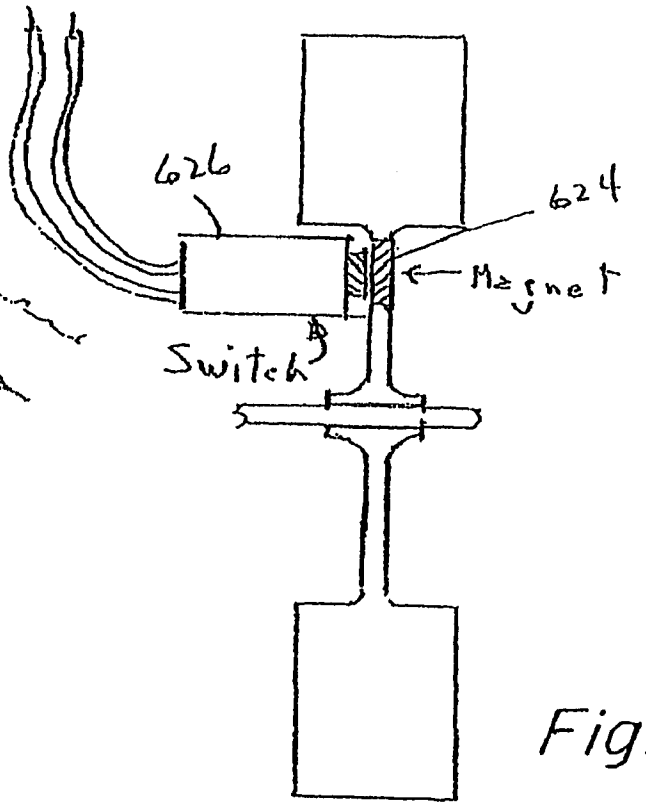
FIGS. 17A and 17B respectively comprise isometric and front views of an additional alternative motion sensor mechanism for producing an electric output signal representing forward body motion.
Figure 17A:
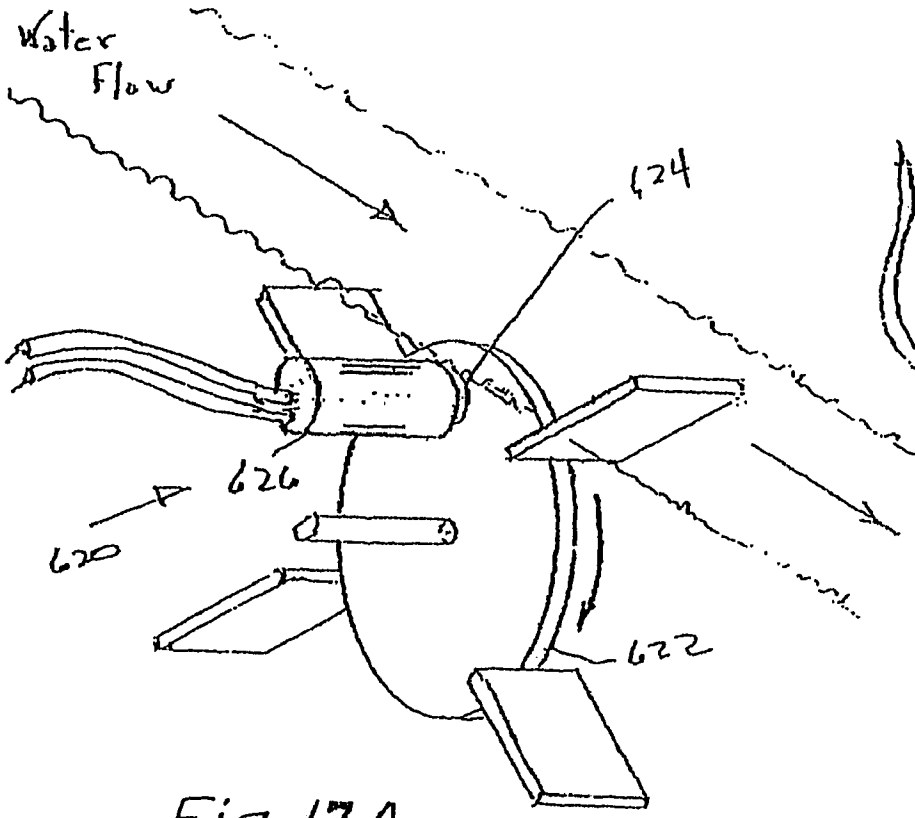

Although only a limited member of electronic and hydraulic controller implementations have been specifically described, it is recognized that various alternative implementations and modification may occur to those skilled in the art falling within the spirit and intended scope of the invention as defined by the appended claims. For example only, the motion sensor mechanism 95 can be implemented in a variety of alternative ways to detect the relative motion of the body through the water. As one example, attention is directed to FIGS. 16A and 16B which show a motion sensor 600 including a paddle 602 mounted for pivoting about shaft 604. The paddle 602 is normally urged by spring 606 to the solid line counter clockwise position 608 shown in FIG. 16A. The paddle 602 is carried by the cleaner body in a manner to cause the paddle to move to the dashed line clockwise position 610 shown in FIG. 16A as the cleaner body moves in a forward direction at a rate greater than T. In the position 610, the paddle contacts pin 612 to close switch 614 which supplies an input to controller 140 (FIG. 5). Another example of an alternative motion sensor 620 is shown in FIGS. 17A and 17B. The motion sensor 620 includes a turbine wheel 622 which is carried by the cleaner body so as to rotate at a rate proportional to the body's forward motion through the water. The wheel 622 carries at least one marker 624, e.g., magnet, reflector, aperture, which can be sensed by a suitable detector 626 as the marker moves therepast. The pulse output rate produced by detector 626 thus represents the speed of wheel 622 and the rate of forward motion of the cleaner body through the water.

The invention claimed is:

1. Apparatus for cleaning a water pool, said apparatus comprising:

a cleaner body adapted for immersion in said water pool, and configured to define a direction of forward motion relative to said body;

a force generator selectively operable to apply a propulsion force $F_P$ oriented to produce forward body motion to trace a first path segment in said water pool;

a motion sensor responsive to the rate of forward body motion being less than a first threshold rate for providing a low motion signal;

said force generator being selectively operable to apply a reposition force $F_R$ oriented to redirect said body for forward motion along a second path segment in said water pool different from said first path segment;

a control subsystem actuatable to execute a reposition operation comprised of one or more successive redirect actions where each such redirect action includes operating said force generator to sequentially apply said force $F_R$, for a limited duration and then apply said force $F_P$; and wherein said control subsystem is actuated in response to said motion sensor providing said low motion signal and includes means for terminating said reposition operation in response to said body exhibiting sustained forward motion greater than a second threshold rate.

2. The apparatus of claim 1 wherein said force $F_R$ is oriented to rotate said body around an axis oriented substantially perpendicular to said direction of forward motion.

3. The apparatus of claim 2 wherein said reposition operation is comprised of at least first and second successive redirect actions; and wherein said second redirect action rotates said body through a greater angle than said first redirect action.

4. The apparatus of claim 1 further including energy generating means carried by said body for powering said force generator and/or said control subsystem.

5. The apparatus of claim 1 further including means for periodically producing a timed reposition signal; and wherein said control subsystem is actuated in response to said timed reposition signal.

6. Apparatus operable in a wall surface mode for cleaning the interior surface of a containment wall and operable in a water surface mode for cleaning the upper surface of a water pool contained therein, said apparatus comprising:

a cleaner body adapted for immersion in said water pool, said body configured to define a forward direction;

a propulsion force generator carried by said cleaner body actuatable to produce body motion in said forward direction along a first path segment in said water pool;

a reposition force generator carried by said cleaner body actuatable to redirect said body forward motion along a second path segment in said water pool different from said first path segment;

a level control force generator carried by said body actuatable to selectively move said body between said wall surface and said water pool surface; and a control subsystem including timer means for (1) periodically actuating said level control force generator to transition said body between said wall surface and said water pool surface and (2) periodically generating a timed reposition command operable when said body is not transitioning to actuate said reposition force generator.

7. The apparatus of claim 6 further including:

motion sensor means for indicating when the rate of forward body motion exceeds a threshold rate; and wherein said control subsystem is responsive to said rate of forward body motion being less than said threshold rate for actuating said reposition force generator.

8. The apparatus of claim 7 wherein actuation of said reposition force generator initiates a reposition operation comprised of one or more successive redirect actions where each such redirect action includes (1) initially operating said reposition force generator to produce a force $F_R$ oriented to redirect said body, (2) subsequently operating said propulsion force generator to produce a force $F_P$ oriented to direct said body motion in said forward direction, and (3) then determining whether said body is exhibiting sustained forward body motion.

9. The apparatus of claim 8 further including means responsive to said body failing to exhibit sustained forward motion for switching the operating mode of said apparatus.

10. The apparatus of claim 6 wherein actuation of said reposition force generator produces a force $F_R$ oriented to rotate said body to redirect it along said second path segment.

11. The apparatus of claim 6 wherein actuation of said reposition force generator initiates a reposition operation comprised of at least first and second successive redirect actions; and wherein said second redirect action rotates said body through a greater angle than said first redirect action.

12. The apparatus of claim 6 further including a conduit having a distal end coupled to said cleaner body for supplying power to said propulsion force generator and/or said reposition force generator and/or said level control force generator.

13. The apparatus of claim 12 further including a power source located outside of said water pool; and means coupling said power source to a proximal end of said conduit.

14. The apparatus of claim 6 further including energy generating means carried by said body for powering at least one of said force generators and/or control subsystem.

15. A control system for moving a cleaner body along a substantially random travel path alternately on the surface of a wall containing a water pool and on the surface of said water pool, said control system including:

a source of positive pressure water;

a rotary valve having a valve element mounted for movement between (1) a first position for discharging water from said source through a first outlet to produce a propulsion force oriented to move said body in a first direction along said wall surface, (2) a second position for discharging water from said source through a second outlet for producing a propulsion force oriented to move said body in a first direction along said water pool surface; and (3) a third position for discharging water through a third outlet to produce a redirect force oriented to move said body in a second direction different from said first direction;

a motor coupled to said valve element; and a controller for actuating said motor to selectively place said valve element in said first position or said second position or said third position.

16. The control system of claim 15 wherein said rotary valve includes a valve body defining a first chamber communicating with said first outlet and a second chamber communicating with said second outlet; and wherein said valve element comprises a disk mounted for rotation relative to sad valve body, said disk including a port for supplying energy to said first chamber when said valve element is in said first position and to said second chamber when said valve element is in said second position.

17. The control system of claim 16 including an electric motor selectively actuatable to rotate said disk.

18. Apparatus for alternately cleaning the surface of a water pool and the surface of a wall containing said water pool, said apparatus comprising;

a cleaner body adapted for travel through said water pool;

a conduit coupling a positive pressure water source to said cleaner body;

a valve assembly carried by said body selectively operable in a first state to produce a propulsion force Fp to direct said body in a first direction along said water pool surface, in a second state to produce a propulsion force $F_P$ to direct said body in a first direction along said wall surface, and in a third state to produce a redirect force $F_R$ to direct said body in a second direction;

a controller carried by said body responsive to multiple input conditions for controlling said valve assembly to selectively define said first, second, and third states; and a generator subsystem carried by said body and driven by said positive pressure water source for supplying electric power to said controller.

19. The apparatus of claim 18 wherein said controller includes a microprocessor.

20. The apparatus of claim 18 wherein said generator subsystem includes a rechargeable battery.

21. The apparatus of claim 18 wherein said valve assembly includes a valve element mounted for movement between first, second, and third positions; and wherein said controller includes an actuator for moving said valve element to any selected one of said positions.

22. The apparatus of claim 21 wherein said actuator comprises a motor.

23. The apparatus of claim 18 further including a timer operable to define at least one of said multiple input conditions.

24. The apparatus of claim 18 further including a sensor for detecting cleaner body motion to define at least one of said multiple input conditions.

25. The apparatus of claim 18 further including a user operable mechanism to define at least one of said multiple input conditions.

26. A method of cleaning a water pool comprising:

placing a cleaner body in said water pool for travel therein;

coupling said cleaner body to an external pump for supplying a positive pressure water flow to said cleaner body;

providing a valve assembly on said cleaner body operable to discharge a water jet therefrom directed to produce either a force Fp for propelling said body along a path through said pool or a force Fr for redirecting the path of said body through said pool;

providing a microprocessor based electronic controller on said cleaner body for controlling said valve assembly;

causing said water flow to generate electric power; and applying said electric power to said controller.

* * * * *